US012089667B1

(12) United States Patent
Andes et al.

(10) Patent No.: US 12,089,667 B1
(45) Date of Patent: Sep. 17, 2024

(54) BODY PAD

(71) Applicant: Wm. T. Burnett IP, LLC, Baltimore, MD (US)

(72) Inventors: Kimberly Andes, Harrogate (GB); Bryan Hammer, Camillus, NY (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 26 days.

(21) Appl. No.: 17/455,267

(22) Filed: Nov. 17, 2021

Related U.S. Application Data

(60) Provisional application No. 63/117,635, filed on Nov. 24, 2020.

(51) Int. Cl.
*A41D 13/05* (2006.01)

(52) U.S. Cl.
CPC ..... *A41D 13/0518* (2013.01)

(58) Field of Classification Search
CPC ..... A41D 13/0518; A41D 31/285; A41D 2500/50
USPC ..... 2/422
See application file for complete search history.

(56) References Cited

U.S. PATENT DOCUMENTS 3,945,041 A 3/1976 Rhee
4,373,211 A 2/1983 Goudreau et al.
4,599,747 A * 7/1986 Robinson ..... A41D 13/08 2/24
4,610,034 A * 9/1986 Johnson ..... A41D 13/00 2/2.5
5,423,087 A 6/1995 Krent et al.
5,621,914 A 4/1997 Ramone et al.
5,742,947 A 4/1998 Davis
5,840,397 A 11/1998 Landi et al.
5,947,918 A 9/1999 Jones et al.
6,029,273 A 2/2000 McCrane
6,748,601 B2 6/2004 LaShoto et al.
7,370,373 B2 5/2008 Kohler
7,503,080 B2 3/2009 Link
7,735,161 B2 6/2010 Purington
7,765,615 B2 8/2010 Eastwood et al.
7,774,860 B2 8/2010 Kohler
7,993,277 B1 8/2011 Link
8,075,981 B2 12/2011 Pearce et al.
8,959,671 B1 2/2015 Mandak
9,839,831 B2 12/2017 Brown et al.
9,907,343 B2 3/2018 Lacey et al.
10,201,196 B2 2/2019 Cox
(Continued)

OTHER PUBLICATIONS

"Standard Test Method and Performance Specification Used in Evaluating the Performance Characteristics of Chest Protectors for Commotio Cordis," National Operating Committee on Standards for Athletic Equipment, NOCSAE DOC (ND) 200-17a m18, Jan. 2018 (11pp).

(Continued)

*Primary Examiner* — Timothy K Trieu
(74) *Attorney, Agent, or Firm* — Plumsea Law Group, LLC

(57) ABSTRACT

Embodiments provide a body pad having a protective layer mounted on a compressible substrate, for absorbing energy from impacts to the body of a user wearing the body pad. Embodiments may provide a chest protector including a chest pad having a protective layer mounted on a compressible substrate, for absorbing energy from impacts to a chest of a user wearing the chest protector.

15 Claims, 38 Drawing Sheets

(56) References Cited

U.S. PATENT DOCUMENTS

| | | | | |
|---|---|---|---|---|
| 10,773,149 | B2 | 9/2020 | Hammer | |
| 2006/0005306 | A1 | 1/2006 | Call et al. | |
| 2006/0080762 | A1 | 4/2006 | Kobren et al. | |
| 2007/0136935 | A1 | 6/2007 | Purington | |
| 2009/0070911 | A1* | 3/2009 | Chang | A63B 71/1225 2/24 |
| 2009/0126087 | A1 | 5/2009 | Armstrong et al. | |
| 2011/0023218 | A1 | 2/2011 | Syska et al. | |
| 2012/0164377 | A1 | 6/2012 | Lin | |
| 2015/0101110 | A1* | 4/2015 | Wagner | A41D 13/0156 2/455 |
| 2016/0302496 | A1 | 10/2016 | Ferrara | |
| 2017/0000197 | A1 | 1/2017 | Marquez et al. | |
| 2018/0092411 | A1 | 4/2018 | Vito | |
| 2018/0132547 | A1 | 5/2018 | Vito et al. | |
| 2018/0140025 | A1* | 5/2018 | Pelletier | A41D 13/065 |
| 2019/0145740 | A1 | 5/2019 | Czerski et al. | |
| 2020/0037680 | A1* | 2/2020 | Person | A41D 13/0518 |

OTHER PUBLICATIONS

Kumar, Kartik et al., "Development of a Chest Wall Protector Effective in Preventing Sudden Cardiac Death by Chest Wall Impact (Commotio Cordis)," Clin J Sport Med, Jan. 2017, vol. 27, No. 1, p. 26-30, <www.cjsportmed. com>.

* cited by examiner

Figure 1 – Load Cell Locations

Figure 2 – Legal Test Impact Area

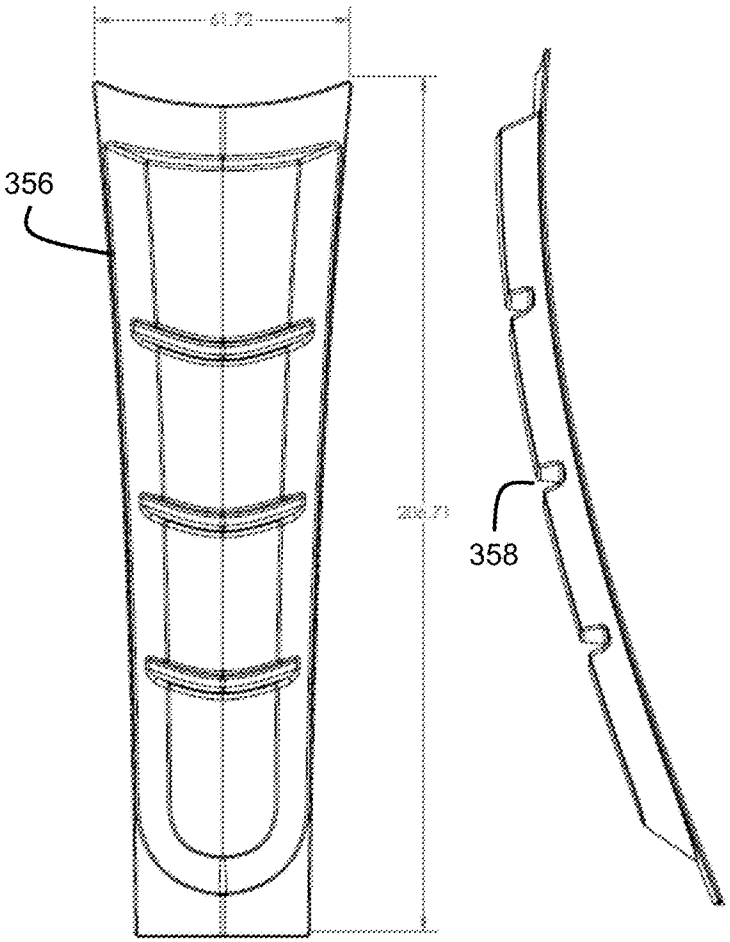
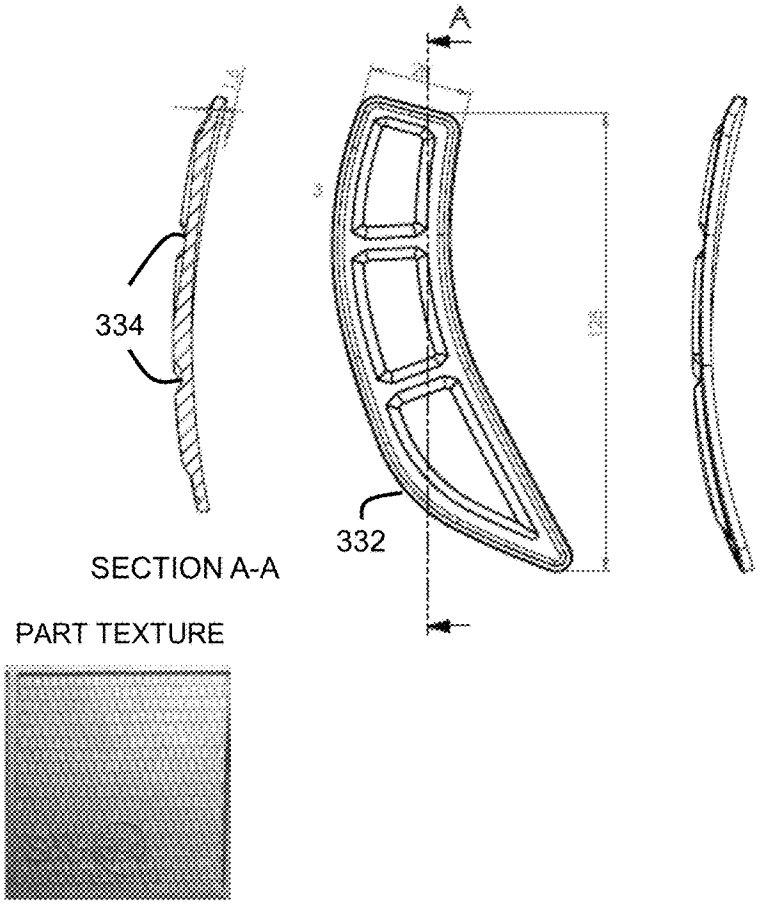
FIG. 9

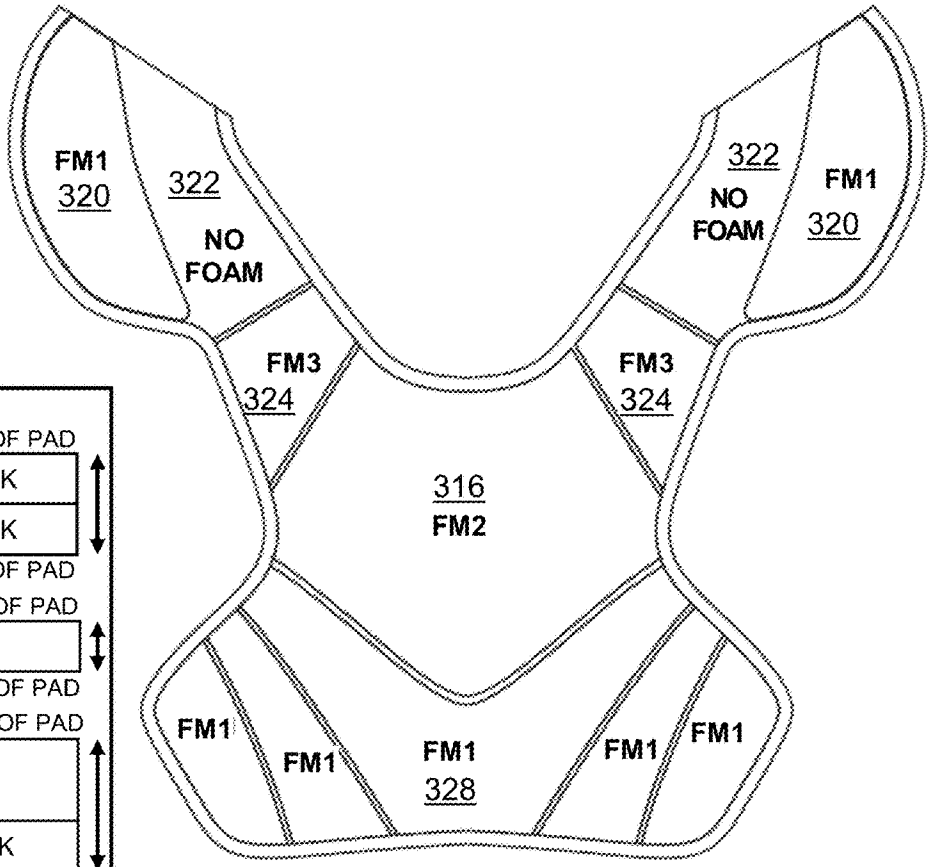

EXAMPLE LAYERS ACCORDING TO AN EMBODIMENT:

| FM1 | | |
|---|---|---|
| LAYER 2 | 3mm ASKER C- 50 DUROMETER EVA FOAM - BLACK | OUTSIDE OF PAD |
| LAYER 1 | 7mm ASKER C- 20 DUROMETER EVA FOAM - BLACK | INSIDE OF PAD |
| TOTAL THICKNESS: 10mm | | |

| FM2 FRONT CHEST STACK UP | | |
|---|---|---|
| LAYER 1 | 35mm BLACK PU FOAM | OUTSIDE OF PAD<br>INSIDE OF PAD |
| TOTAL THICKNESS: 35mm | | |

| FM3 | | |
|---|---|---|
| LAYER 2 | 3mm ASKER C- 50 DUROMETER PE FOAM – PERFORATED PATTERN - BLACK | OUTSIDE OF PAD |
| LAYER 1 | 7mm ASKER C- 35 DUROMETER EVA FOAM - BLACK | INSIDE OF PAD |
| TOTAL THICKNESS: 10mm | | |

*FIG. 13*

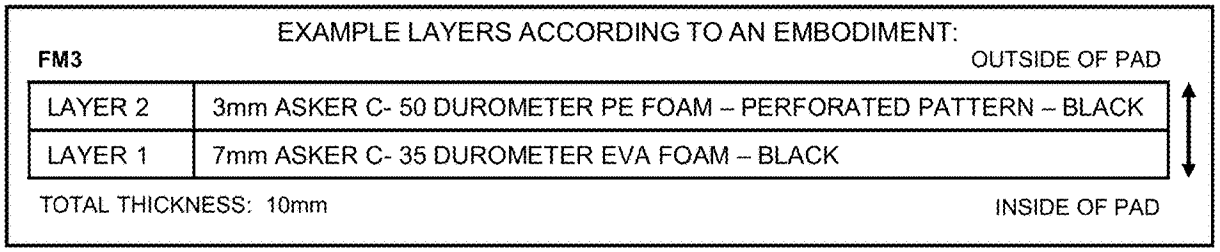
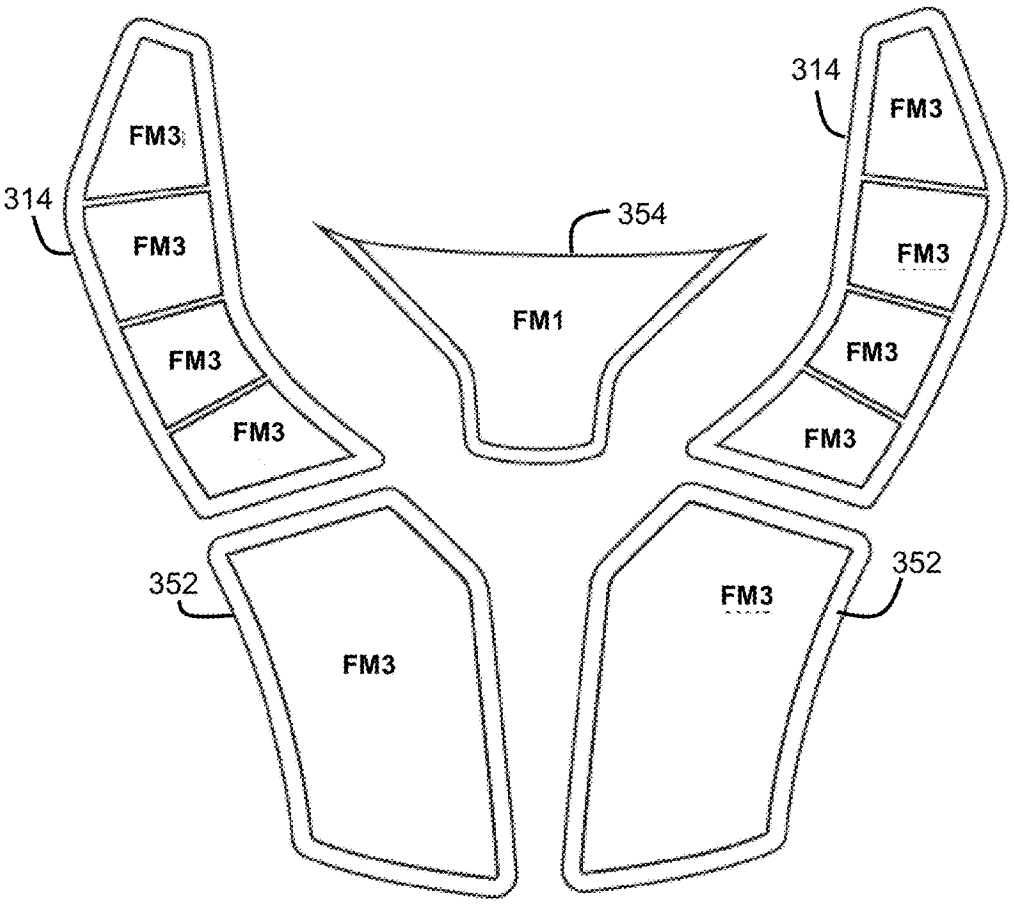
FIG. 14

INNER SURFACE

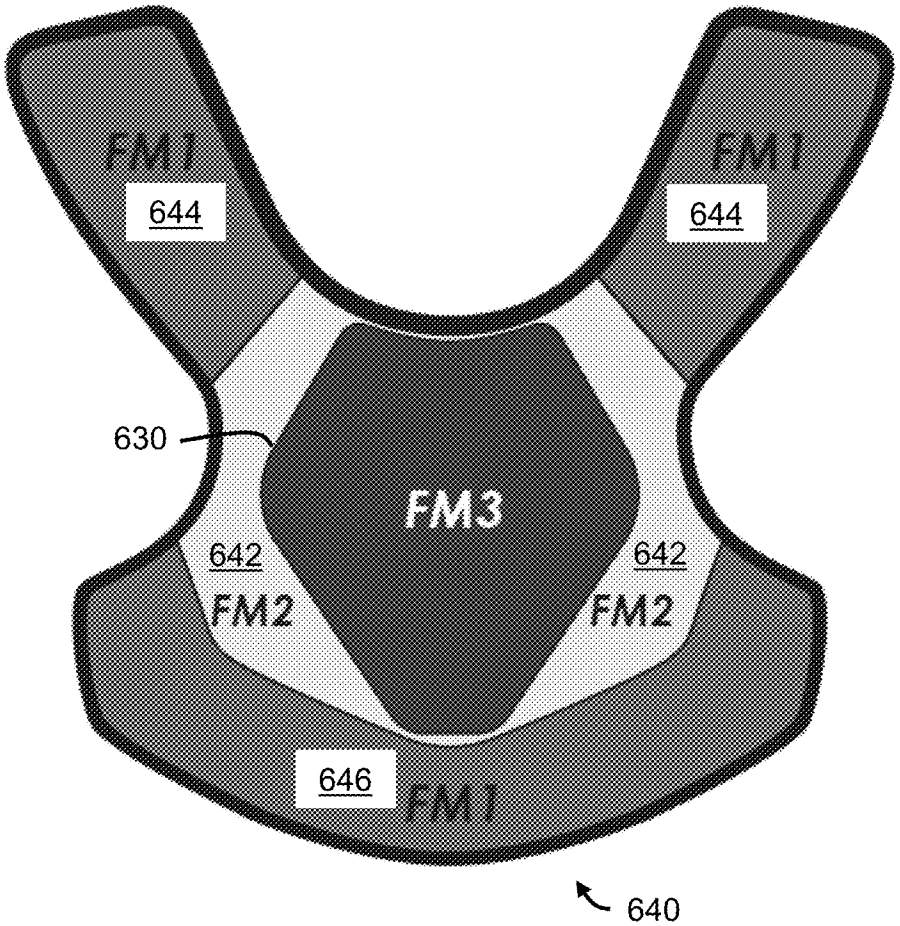

EXAMPLE LAYERS ACCORDING TO AN EMBODIMENT:

FM1

| | | |
|---|---|---|
| | | OUTSIDE OF PAD |
| LAYER 2 | C1040 (3mm EVA 40 DURO ASKER C) | |
| LAYER 1 | LC 12mm EPE | |
| TOTAL THICKNESS: 15mm | | INSIDE OF PAD |

FM2

| | | |
|---|---|---|
| | | OUTSIDE OF PAD |
| LAYER 2 | 10mm EVA FOAM 25 DURO ASKER C | |
| LAYER 1 | 20mm GREY PU FOAM | |
| TOTAL THICKNESS: 30mm | | INSIDE OF PAD |

FM3

| | | |
|---|---|---|
| | | OUTSIDE OF PAD |
| LAYER 4 | 3mm TEXTURED & CURVED PE BOARD | |
| LAYER 3 | 10mm EVA FOAM 25 DURO ASKER C | |
| LAYER 2 | 3mm TEXTURED & CURVED PE BOARD | |
| LAYER 1 | 20mm GREY PU FOAM | |
| TOTAL THICKNESS: 36mm | | INSIDE OF PAD |

*FIG. 26*

TESTING: RESULTS

| HARD LAYER | | SOFT LAYER | TESTING RESULTS | |
|---|---|---|---|---|
| **RIBBED / FLAT** | **THICKNESS (mm)** | **THICKNESS (mm)** | **30 mph** | **50 mph** |
| FLAT | 1.34 | 60 | 68 | 185.6 |
| **FLAT** | **2.7** | **60** | 67.3 | 164.12 |
| FLAT | 4 | 20 | 100.2 | 211.2 |
| FLAT | 4 | 5 | 114.5 | 223.3 |
| FLAT | 4 | 35 | 95 | 200.0 |
| FLAT | 4 | 40 | 83.3 | 197.5 |
| **FLAT** | **4** | **45** | 80 | 178.6 |
| RIBBED AND CURVED | 1.34 | 60 | 75.2 | 181.3 |
| **RIBBED AND CURVED** | **2.7** | **60** | 66.6 | 161.3 |
| RIBBED AND CURVED | 4 | 20 | 96.1 | 207.4 |
| RIBBED AND CURVED | 4 | 5 | 109.7 | 230.7 |
| **RIBBED AND CURVED** | **4** | **35** | 88.5 | 178.2 |
| NO HARD LAYER - ONLY SPONGE FOAM | | 60 | 101.7 | 227.5 |

TESTING: RESULTS

| HARD LAYER | | SOFT LAYER | TESTING RESULTS | |
|---|---|---|---|---|
| **RIBBED / FLAT** | **THICKNESS (mm)** | **THICKNESS (mm)** | **30 mph** | **50 mph** |
| FLAT | 4 | 20 | 100.2 | 211.2 |
| FLAT | 4 | 35 | 95 | 200.0 |
| FLAT | 4 | 40 | 83.3 | 197.5 |
| **FLAT** | **4** | **45** | 80.0 | 178.6 |
| RIBBED AND CURVED | 4 | 20 | 96.1 | 207.4 |
| **RIBBED AND CURVED** | **4** | **35** | 88.5 | 178.2 |

EXAMPLE LAYERS ACCORDING TO AN EMBODIMENT:

FM1 — OUTSIDE OF PAD

| | |
|---|---|
| LAYER 2 | C1040 (3mm EVA 40 DURO ASKER C) |
| LAYER 1 | LC 12mm EPE |

TOTAL THICKNESS: 15mm — INSIDE OF PAD

FM2 — OUTSIDE OF PAD

| | |
|---|---|
| LAYER 2 | 10mm EVA FOAM 25 DURO ASKER C |
| LAYER 1 | 20mm GREY PU FOAM |

TOTAL THICKNESS: 30mm — INSIDE OF PAD

FM3 — OUTSIDE OF PAD

| | |
|---|---|
| LAYER 4 | 3mm TEXTURED & CURVED PE BOARD |
| LAYER 3 | 10mm EVA FOAM 25 DURO ASKER C |
| LAYER 2 | 3mm TEXTURED & CURVED PE BOARD |
| LAYER 1 | 20mm GREY PU FOAM |

TOTAL THICKNESS: 36mm — INSIDE OF PAD

FM4 — OUTSIDE OF PAD

| | |
|---|---|
| LAYER 1 | 1mm PE BOARD IN GLOSS BLACK |

TOTAL THICKNESS: 25mm — INSIDE OF PAD

FM5 — OUTSIDE OF PAD

| | |
|---|---|
| LAYER 2 | I-10030 (3mm E-FOAM 10x) |
| LAYER 1 | C1040 (5mm EVA 40 DURO ASKER C) |
| GLUED TOGETHER IN PRECURVE SO IT CAN WRAP AROUND SHOULDER | |

TOTAL THICKNESS: 8mm — INSIDE OF PAD

FM6 — OUTSIDE OF PAD

| | |
|---|---|
| LAYER 4 | C1600 (3mm EVA 25 DURO ASKER C) |
| LAYER 3 | 1mm PE BOARD |
| LAYER 2 | C1040 (3mm EVA 40 DURO ASKER C) |
| LAYER 1 | LC 12mm EPE |

TOTAL THICKNESS: 19mm — INSIDE OF PAD

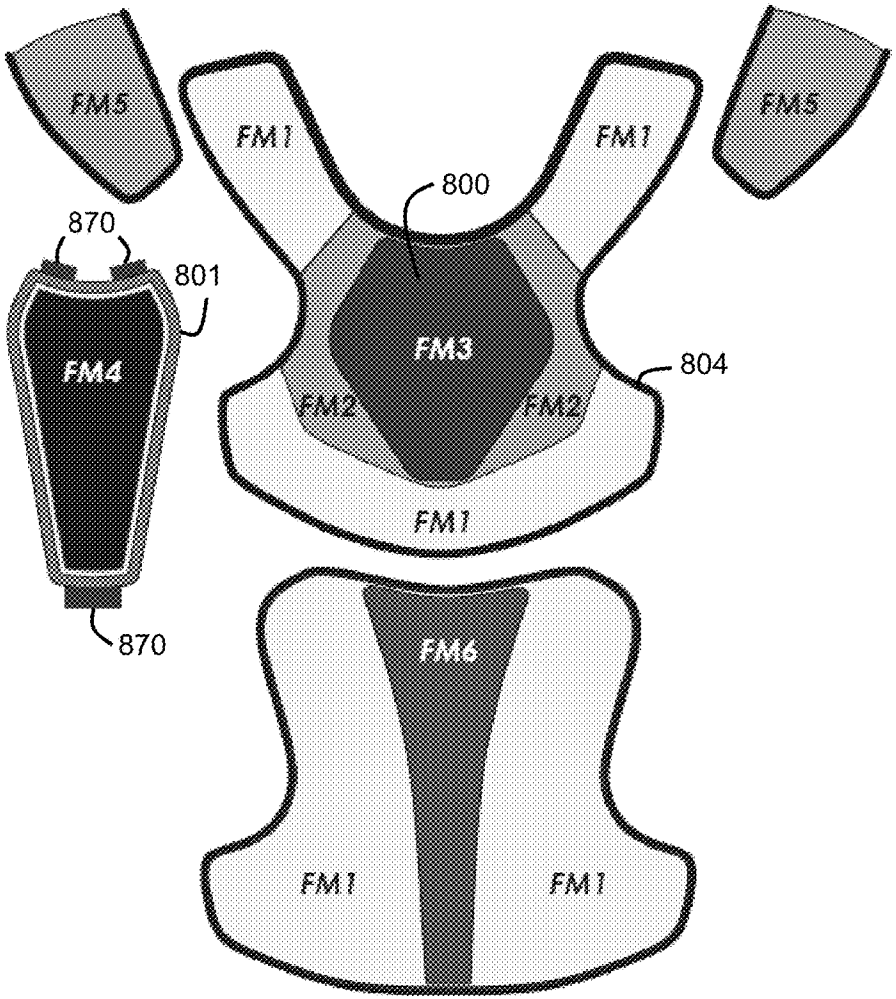

FIG. 38

BODY PAD

CROSS-REFERENCE TO RELATED APPLICATION

This application claims the benefit of U.S. Provisional Application No. 63/117,635, filed Nov. 24, 2020, which is herein incorporated by reference in its entirety.

BACKGROUND

Field

The present embodiments relate generally to personal protective equipment, and more particularly, to a body pad having a protective layer mounted on a compressible substrate, for absorbing energy from impacts to the body of a user wearing the body pad, especially the chest of the user.

Background

A person may wear protective equipment, such as soft pads, over portions of the body, to absorb or deflect impacts from projectiles such as baseballs, hockey pucks, and lacrosse balls. Such protective equipment, however, may not adequately protect the vulnerable areas of the body, including the chest. In addition, the protective equipment may be overly stiff and rigid, causing discomfort for a user and compromising athletic performance.

SUMMARY

Embodiments provide a body pad, such as a chest protector, having a protective layer mounted on a compressible substrate.

An embodiment provides a body pad having a substrate portion and a protective layer portion disposed on the substrate portion. When viewed from a front view, the substrate portion and the protective layer portion may extend generally in an x-direction and a y-direction defining an x-y plane. Along the y-direction, the protective layer portion and the substrate portion may be curved outwardly in a z-direction perpendicular to the x-y plane. The substrate portion may have a thickness within a range of about 3 mm to about 15 mm, a density within a range of about 0.02 g/cm$^3$ to about 0.25 g/cm$^3$, and a Shore A hardness within a range of about 10 to about 40. The protective layer portion may have a thickness within a range of about 1 mm to about 5 mm, a density within a range of about 0.75 g/cm$^3$ to about 1.4 g/cm$^3$, and a Shore D hardness within a range of about 20 to about 55.

In an aspect, the protective layer portion may comprise at least one of a polyethylene board, a polyethylene weave, or a polypropylene thermoplastic composite.

In another aspect, the substrate portion may comprise one of ASKER C 50 Durometer ethylene-vinyl acetate or cold compressed ASKER C 35 Durometer ethylene-vinyl acetate.

In another aspect, along the y-direction, the substrate portion and the protective layer portion may be curved outwardly in the z-direction at a radius of curvature, which may be within a range of about 265 mm to about 665 mm.

In another aspect, the substrate portion may have a frame portion that defines a recessed area in which the protective layer portion is disposed.

In another aspect, the protective layer portion may define at least one of protrusions or corrugation to increase rigidity of the protective layer portion.

In another aspect, the body pad may meet requirements of National Operating Committee on Standards for Athletic Equipment NOCSAE Doc (ND) 200-17a M18, Revised June 2017, Modified January 2018, Effective June 2018, defining a cardiac silhouette location, a lower load cell location, and an upper load cell location, when the body pad is placed over the cardiac silhouette location, the lower load cell location, and the upper load cell location.

Another embodiment provides a body pad having a substrate portion and a protective layer portion disposed on the substrate portion. When viewed from a front view, the substrate portion and the protective layer portion may extend generally in an x-direction and a y-direction defining an x-y plane. Along the y-direction, the protective layer portion may be curved outwardly in a z-direction perpendicular to the x-y plane. The substrate portion may have a thickness within a range of about 30 mm to about 65 mm, a density within a range of about 0.01 g/cm$^3$ to about 0.1 g/cm$^3$, and a Shore OO hardness within a range of about 0 to about 50. The protective layer portion may have a thickness within a range of about 1.5 mm to about 5 mm, a density within a range of about 0.75 g/cm$^3$ to about 1.4 g/cm$^3$, and a Shore D hardness within a range of about 20 to about 55.

In an aspect, the protective layer portion may comprise at least one of a polyethylene board, a polyethylene weave, or a polypropylene thermoplastic composite.

In another aspect, the substrate portion may comprise a polyurethane foam.

In another aspect, along the y-direction, the substrate portion may be curved outwardly in the z-direction at a radius of curvature substantially equal to a radius of curvature of the protective layer portion along the x-direction.

In another aspect, along the y-direction, the protective layer portion may have a radius of curvature within a range of about 265 mm to about 665 mm.

In another aspect, along the x-direction the protective layer portion may have a radius of curvature within a range of about 578 mm to about 1178 mm.

In another aspect, along the x-direction, the substrate portion may be curved outwardly in the z-direction.

In another aspect, the protective layer portion may be corrugated to increase rigidity of the protective layer portion.

In another aspect, the protective layer portion may have rows of hexagonal depressions extending in the x-direction. The hexagonal depressions may be elongated in the y-direction, and each row of hexagonal depressions may be offset in the x-direction from an adjacent row of hexagonal depressions such that adjacent rows of hexagonal depressions mesh with each other.

In another aspect, each hexagonal depression may define a first elongated side, a second elongated side opposite to the first elongated side, a first triangular longitudinal end defining a first vertex, a second triangular longitudinal end opposite to the first triangular longitudinal end and defining a second vertex, and a central valley extending from the first vertex to the second vertex.

In another aspect, the body pad may be configured to be worn on a chest of a user with the substrate portion disposed closest to the user. When viewing the body pad from the z-direction, the body pad may define a concave upper edge and four side edges. The concave upper edge may be configured to be disposed under a neck of the user and have a first end portion and a second end portion. The first side edge may extend from the first end portion of the concave upper edge and angle outwardly with respect to the x-direction toward a first side obtuse corner portion. The second side edge may be opposite to the first side edge, and may extend from the second end portion of the concave upper edge and angle outwardly with respect the x-direction toward a second side obtuse corner portion apex. The third side edge may extend from the first side obtuse corner portion and angle inwardly with respect to the x-direction. The fourth side edge may extend from the second side obtuse corner portion and angle inwardly with respect to the x-direction. The body pad may be configured to extend across a chest of the user from the first side obtuse corner portion to the second side obtuse corner portion.

In another aspect, the protective layer portion may comprise a first protective layer portion, and the body pad may further comprise an intermediate layer and a second protective layer portion. The intermediate layer may be disposed over the first protective layer portion on a side of the first protective layer portion opposite to the substrate portion. The second protective layer portion may be disposed on the intermediate layer on a side of the intermediate layer opposite to the first protective layer portion. Along the y-direction, the second protective layer portion may be curved outwardly in the z-direction.

In another aspect, the intermediate layer may comprise ethylene-vinyl acetate foam having a Durometer Type C hardness of 25 and having a thickness within a range of about 3 mm to about 35 mm, and the second protective layer portion may comprise polyethylene board and has a thickness within a range of about 0.5 mm to about 4 mm, a density within a range of about 0.75 g/cm$^3$ to about 1.4 g/cm$^3$, and a Shore D hardness within a range of about 20 to about 55.

In another aspect, the body pad may meet requirements of National Operating Committee on Standards for Athletic Equipment NOCSAE Doc (ND) 200-17a M18, Revised June 2017, Modified January 2018, Effective June 2018, defining a cardiac silhouette location, a lower load cell location, and an upper load cell location, when the body pad is placed over the cardiac silhouette location, the lower load cell location, and the upper load cell location.

Another embodiment provides a body pad having a substrate portion, a first protective layer portion, an intermediate layer, and a second protective layer portion. The first protective layer portion may be disposed on the substrate portion. When viewed from a front view, the substrate portion and the protective layer portion may extend generally in an x-direction and a y-direction defining an x-y plane. Along the y-direction, the protective layer portion may be curved outwardly in a z-direction perpendicular to the x-y plane. The substrate portion may have a thickness within a range of about 10 mm to about 60 mm, a density within a range of about 0.01 g/cm$^3$ to about 0.1 g/cm$^3$, and a Shore OO hardness within a range of about 0 to about 50. The protective layer portion may have a thickness within a range of about 1 mm to about 5 mm, a density within a range of about 0.75 g/cm$^3$ to about 1.4 g/cm$^3$, and a Shore D hardness within a range of about 20 to about 55. The intermediate layer may be disposed over the first protective layer portion on a side of the first protective layer portion opposite to the substrate portion. The intermediate layer may comprise ethylene-vinyl acetate foam having a Durometer Type C hardness of 25 and having a thickness within a range of about 3 mm to about 35 mm. The second protective layer portion may be disposed on the intermediate layer on a side of the intermediate layer opposite to the first protective layer portion. Along the y-direction, the second protective layer portion may be curved outwardly in the z-direction. The second protective layer portion may comprise polyethylene board and may have a thickness within a range of about 0.5 mm to about 4 mm, a density within a range of about 0.75 g/cm$^3$ to about 1.4 g/cm$^3$, and a Shore D hardness within a range of about 20 to about 55.

Other systems, devices, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

FIG. 9 is a schematic diagram that illustrates embodiments of a molded part and a lower spine pad;

FIG. 13 is a schematic diagram that illustrates embodiments of foam stack ups of a front portion (or vest) of a pad system;

FIG. 14 is a schematic diagram that illustrates embodiments of foam stack ups of a front portion (or vest) of a pad system;

FIG. 26 is a schematic diagram that illustrates an embodiment of a front portion of a pad system incorporating a four-layer chest pad such as the chest pad of FIG. 18;

FIGS. 37-38 are schematic diagrams that illustrate another embodiment of a pad system, incorporating a multilayer chest pad and an additional outer elongated chest pad mounted over the multilayer chest pad.

DETAILED DESCRIPTION

Embodiments provide a body pad having a protective layer mounted on a compressible substrate, for absorbing energy from impacts to the body of a user wearing the body pad. In particular, embodiments may provide a chest protector including a chest pad having a protective layer mounted on a compressible substrate, for absorbing energy from impacts to a chest of a user wearing the chest protector. The protective layer may be more rigid and less compressible than the substrate, and in embodiments, may be considered to be a chest plate.

Embodiments may be particularly suited for absorbing impacts to areas of the chest that are generally considered more likely to result in injuries, and may be configured to meet industry-accepted testing criteria. An example of such criteria is the "Standard Test Method and Performance Specification Used in Evaluating the Performance Characteristics of Chest Protectors for Commotio Cordis," NOCSAE Doc (ND) 200-17a M18, Revised June 2017, Modified January 2018, Effective June 2018, by the National Operating Committee on Standards for Athletic Equipment ("NOCSAE"), which is referred to herein as the "NOCSAE chest protector standards," and is herein incorporated by reference.

Figure 1:
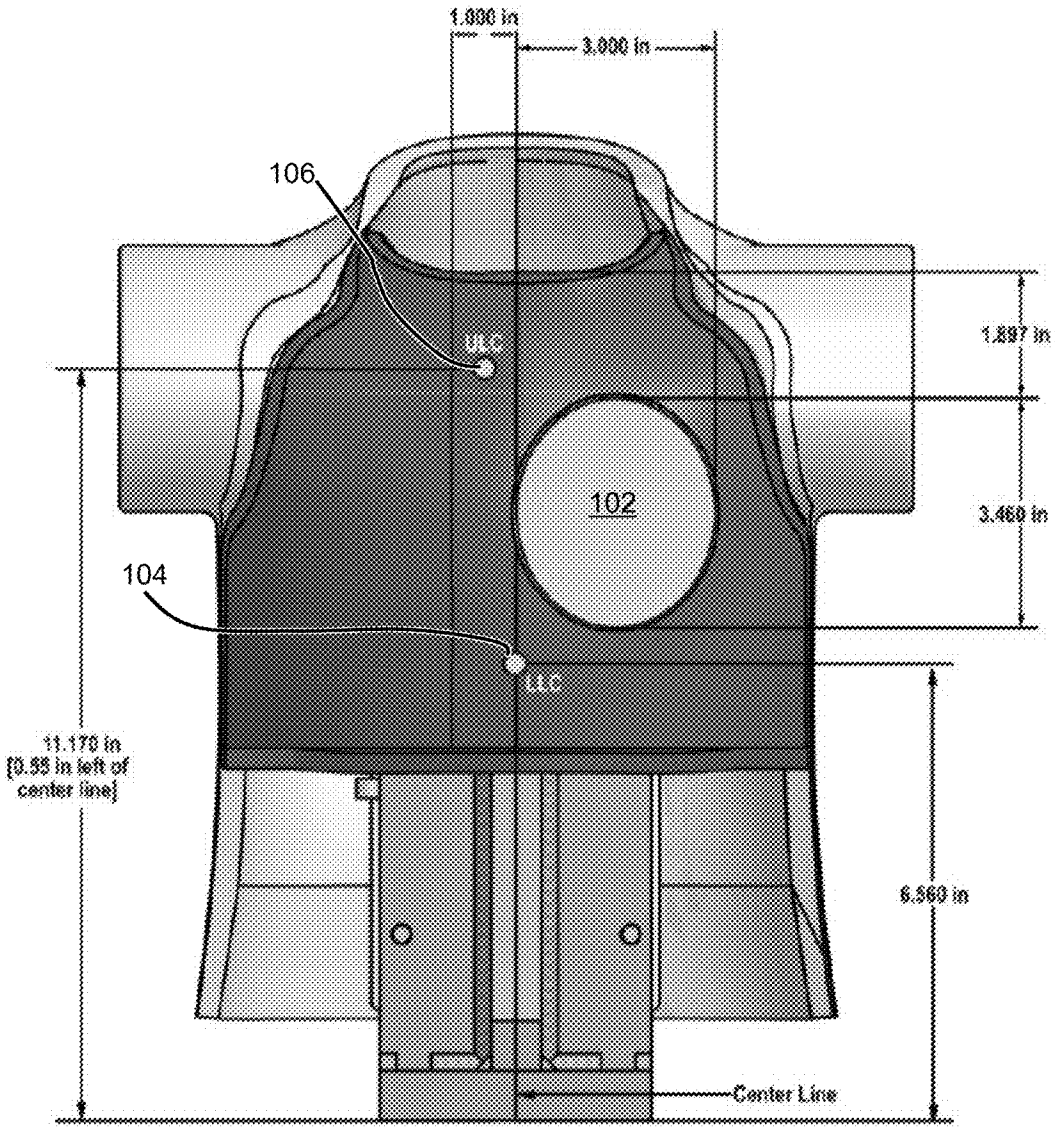
FIG. 1 illustrates FIG. 1 of the National Operating Committee on Standards for Athletic Equipment ("NOCSAE") chest protector standards.
Figure 2:
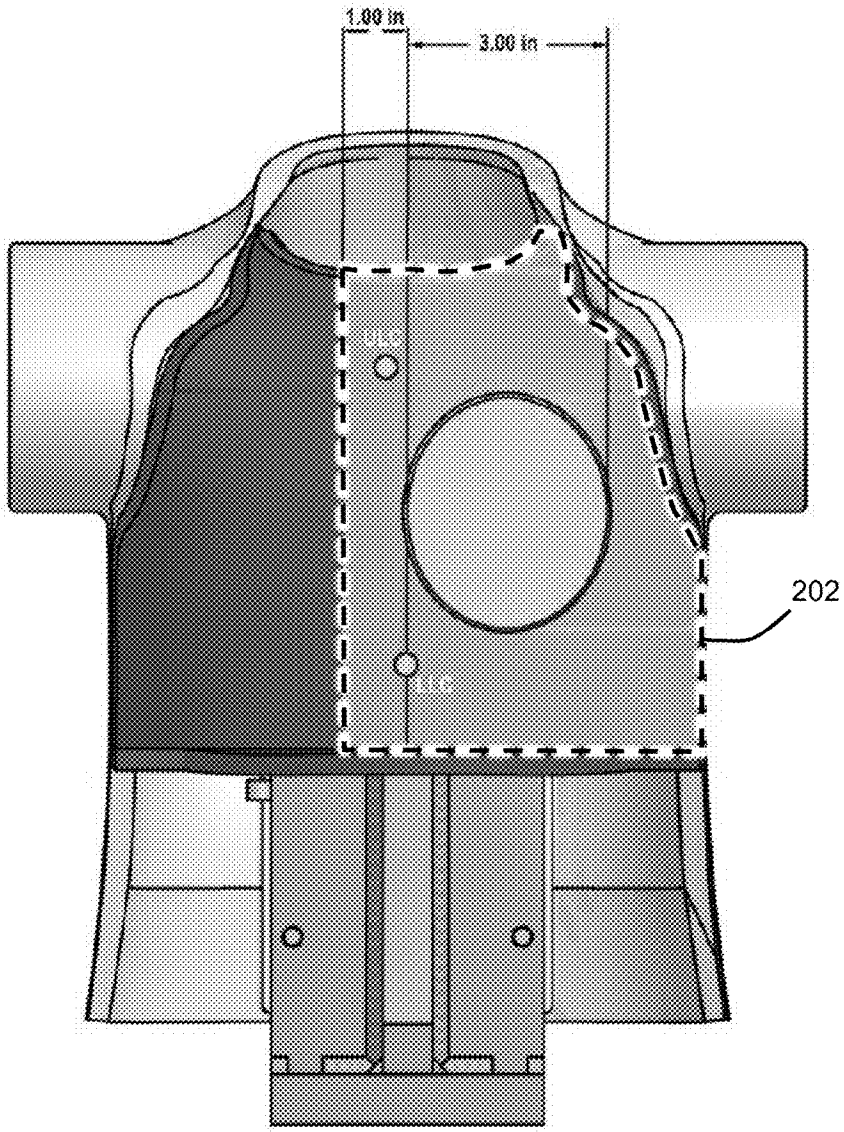
FIG. 2 illustrates FIG. 2 of the NOCSAE chest protector standards.

The NOCSAE chest protector standards describe laboratory equipment and basic requirements pertinent to projectile testing of chest protectors using an NOCSAE Thoracic Surrogate. Compliance with the requirements is believed to improve chest protector performance and reduce the risk of commotio cordis. Commotio cordis is a condition in which ventricular fibrillation occurs following a blunt, nonpenetrating blow to the chest, specifically the precordial area, in an individual with no underlying cardiac disease. FIG. 1 illustrates FIG. 1 of the NOCSAE chest protector standards, indicating the three load cell locations at which projectiles impact the chest protector during a test. The three locations are the center (+¼ inch) of the cardiac silhouette 102, the lower load cell 104, and the upper load cell 106. FIG. 2 illustrates FIG. 2 of the NOCSAE chest protector standards, indicating the padded impact area 202 in which random location impacts may be directed as part of the test.

Embodiments may provide chest protectors and/or pad systems configured to meet the NOCSAE standards, due at least in part to the incorporation of a chest pad having a protective layer mounted on a compressible substrate.

Figure 3:
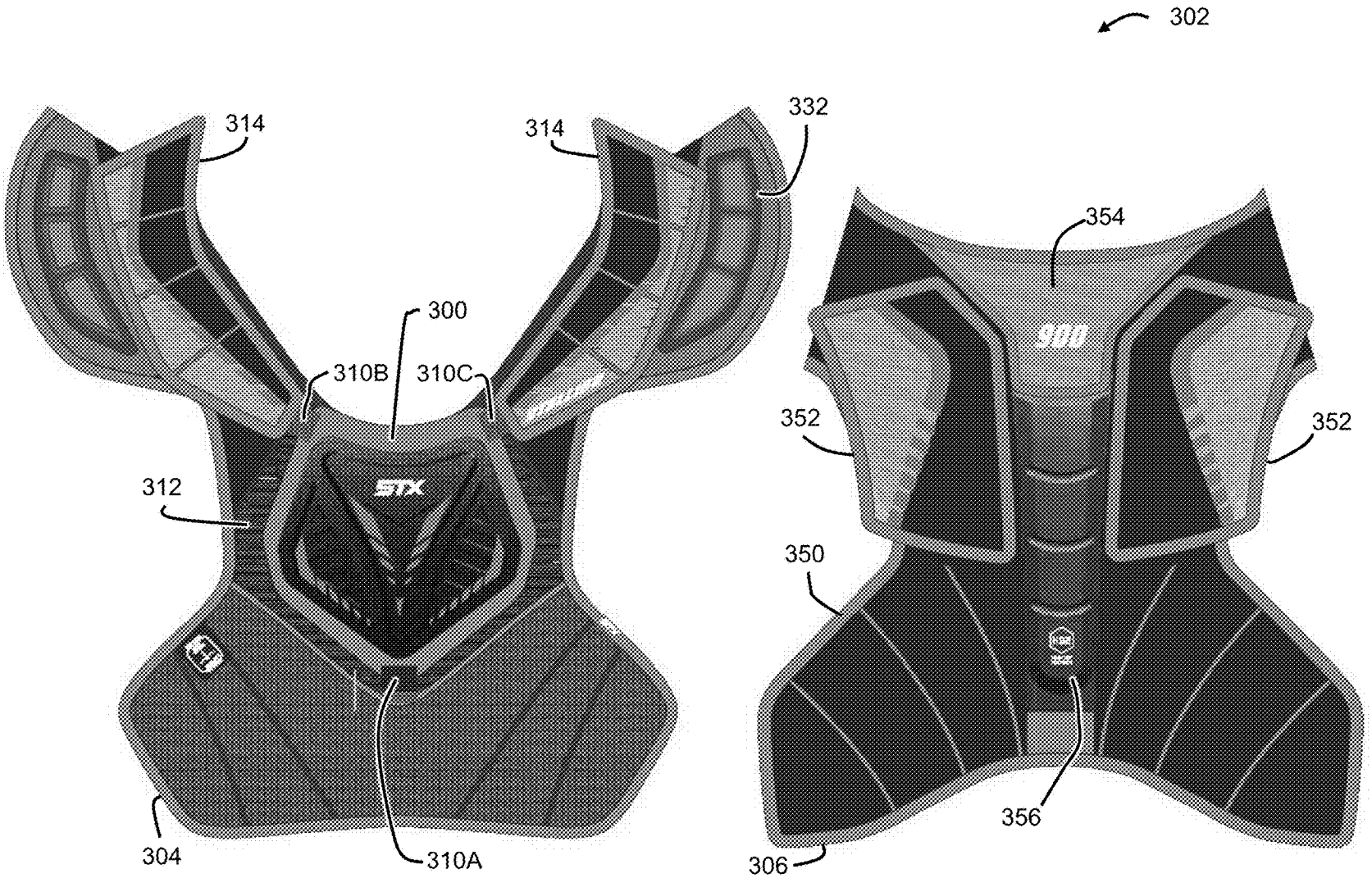
FIG. 3 is a schematic diagram that illustrates an embodiment of a pad system, including a body pad, which in this example is a chest pad.
Figure 4:
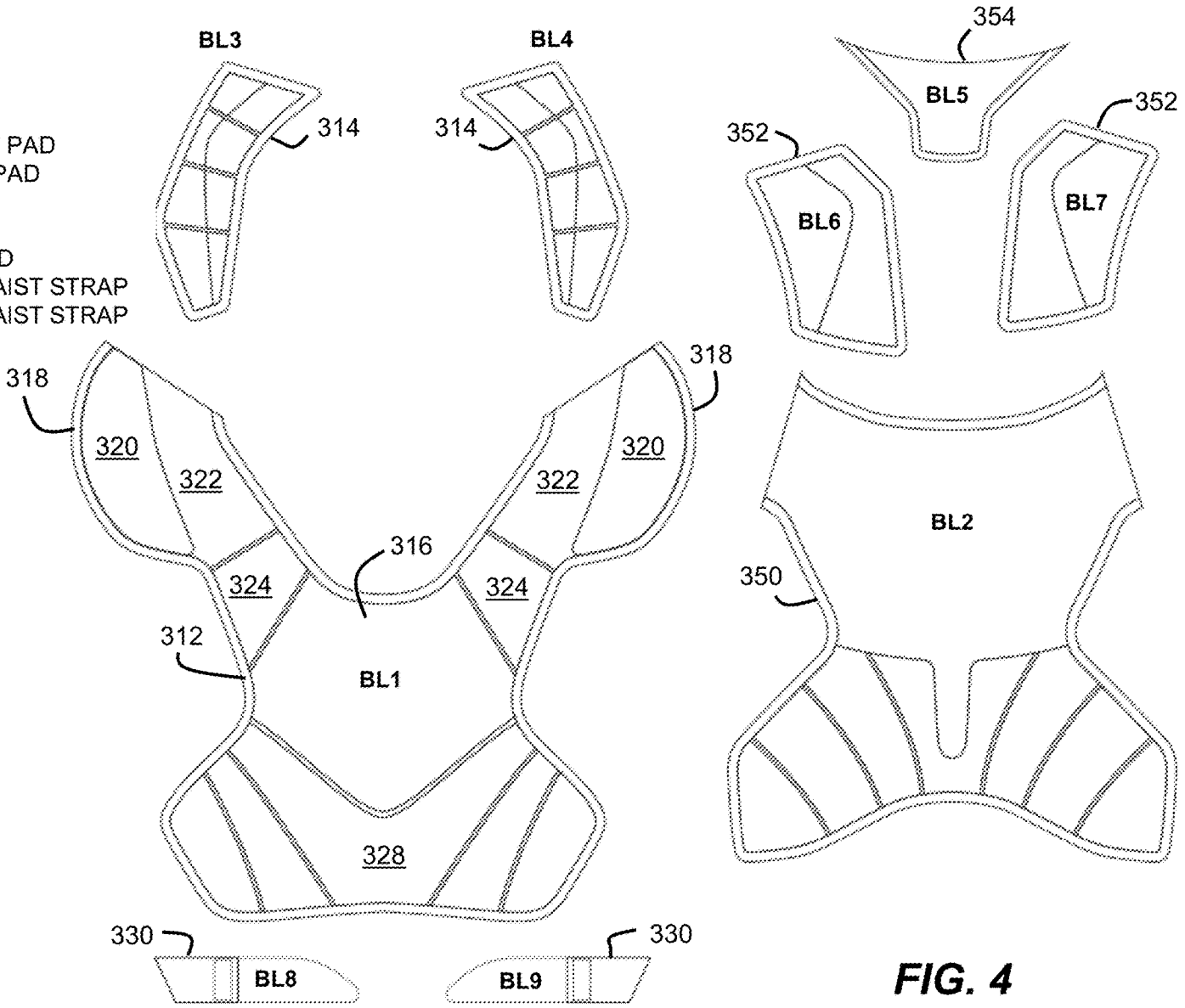
FIG. 4 is a schematic diagram that illustrates embodiments of cut and sewn parts of a pad system.
Figure 16:
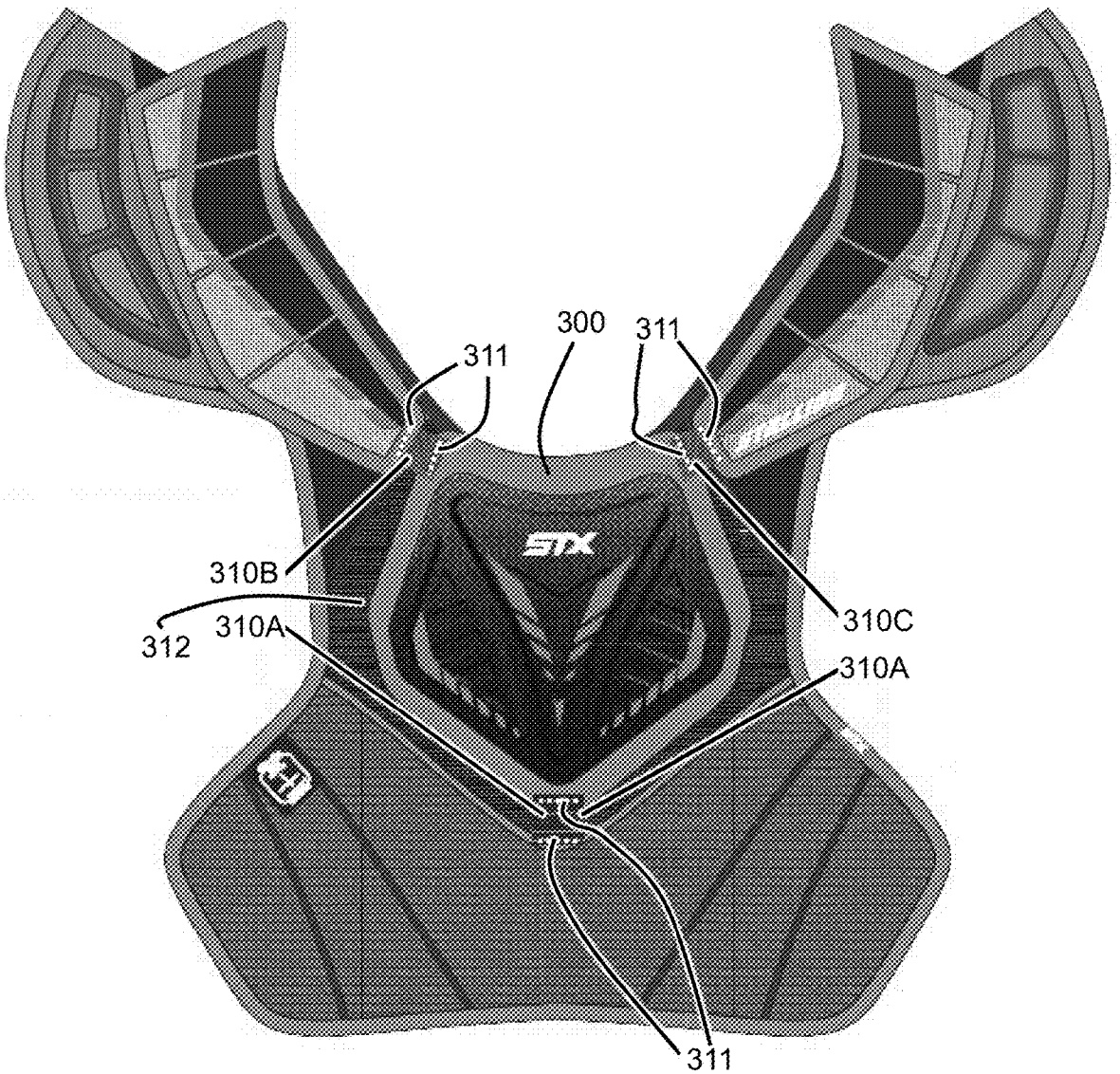
FIG. 16 is a schematic diagram that illustrates an embodiment of assembled front and shoulder portions of a pad system.

FIG. 3 illustrates a body pad according to an embodiment, which in this example is a chest pad 300. As shown, chest pad 300 may be incorporated into a pad system 302 for protecting the torso and shoulders of a user. In this example, the pad system 302 includes a front portion 304 configured to cover the chest and shoulders of a user, and a back portion 306 configured to cover the back of the user. Chest pad 300 may be positioned on the front portion 304 so as to cover, when worn by a user, the locations 102, 104, 106 of FIG. 1 and a majority of the impact area 202 of FIG. 2. As shown in FIGS. 3 and 16, chest pad 300 may be flexibly affixed to a base portion 312 (which may also be referred to as a front vest) of the front portion 304, for example, using flexible members 310A, 310B, 310C (e.g., 20 mm elastic band) at perimeter locations of the chest pad 300, which in this example are three locations. Flexible members 310A, 310B, 310C may attach the chest pad 300 to a base portion 312 of the front portion 304 and/or to other components of the front portion 304, such as the collarbone pads 314. Flexible members 310A, 310B, 310C may attach to the chest pad 300, the base portion 312, and the collarbone pads 314 along attachment points as represented by the dashed lines 311 in FIG. 16, which may be, for example, stitching, adhesive, or welding. In an embodiment, FIG. 4 illustrates in isolation an exemplary base portion 312 of the front portion 304, which may also be considered a front vest of the pad system 302.

In one embodiment, as shown in FIGS. 3 and 16, chest pad 300 may have a first flexible member 310A attached to the base portion 312 at a lowermost point of the chest pad 300, and second and third flexible members 310B, 310C attached to the base portion 312 at upper left and right corners of the chest pad 300. In another embodiment, flexible member 310A may be attached to the base portion 312, and flexible member 310B, 310C may be attached to the collarbone pads 314 and not directly to the base portion 312. All of these flexible member embodiments may allow the chest pad 300 to move, or "float," relative to the base portion 312 and other components of the front portion 304, to provide a wearer with comfort and flexibility, and to allow the chest pad 300 to remain positioned over the locations 102, 104, 106 and within the impact area 202.

To provide desired chest protection and comfort, embodiments may include provisions for a multilayer chest pad construction, with each layer providing a performance function. FIGS. 5-8 illustrate one multilayer embodiment in which a chest pad 300 may have two layers, including an outer protective layer 502 mounted on a compressible substrate 504. While both layers may provide impact protection, substrate 504 may be more compressible, or softer, to provide a more comfortable contact with a user's body. Substrate 504 may also provide a base for securing the outer protective layer 502 to a pad system. In embodiments, outer protective layer 502 may be considered a chest plate.

Outer protective layer 502 may be a molded thermoplastic composite, such as a polypropylene thermoplastic composite in which oriented polypropylene tapes are bonded in a polypropylene matrix. An example of a suitable thermoplastic composite material is Curv®, produced by Propex Furnishing Group of Gronau, Germany. In embodiments, outer protective layer 502 may be an approximately 2.95 mm thick thermoplastic composite material. In other embodiments, outer protective layer 502 may be made of a polyethylene board or a polyethylene weave (e.g., Max Poly™). In an embodiment, outer protective layer 502 may be made of polyethylene board having a thickness of approximately 3 mm.

Figure 5:
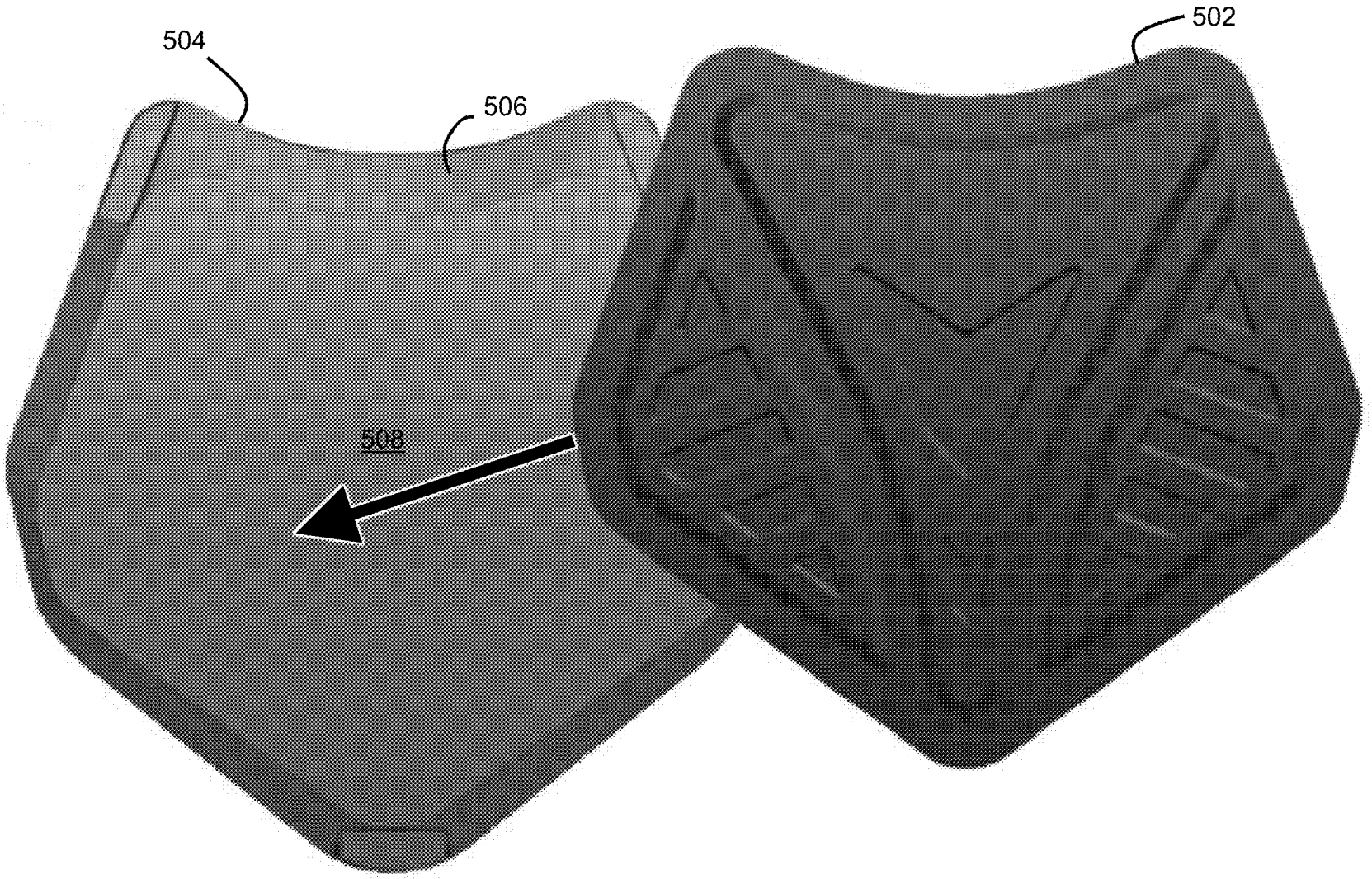
FIG. 5 is a schematic diagram that illustrates an embodiment of a chest pad.
Figure 6:
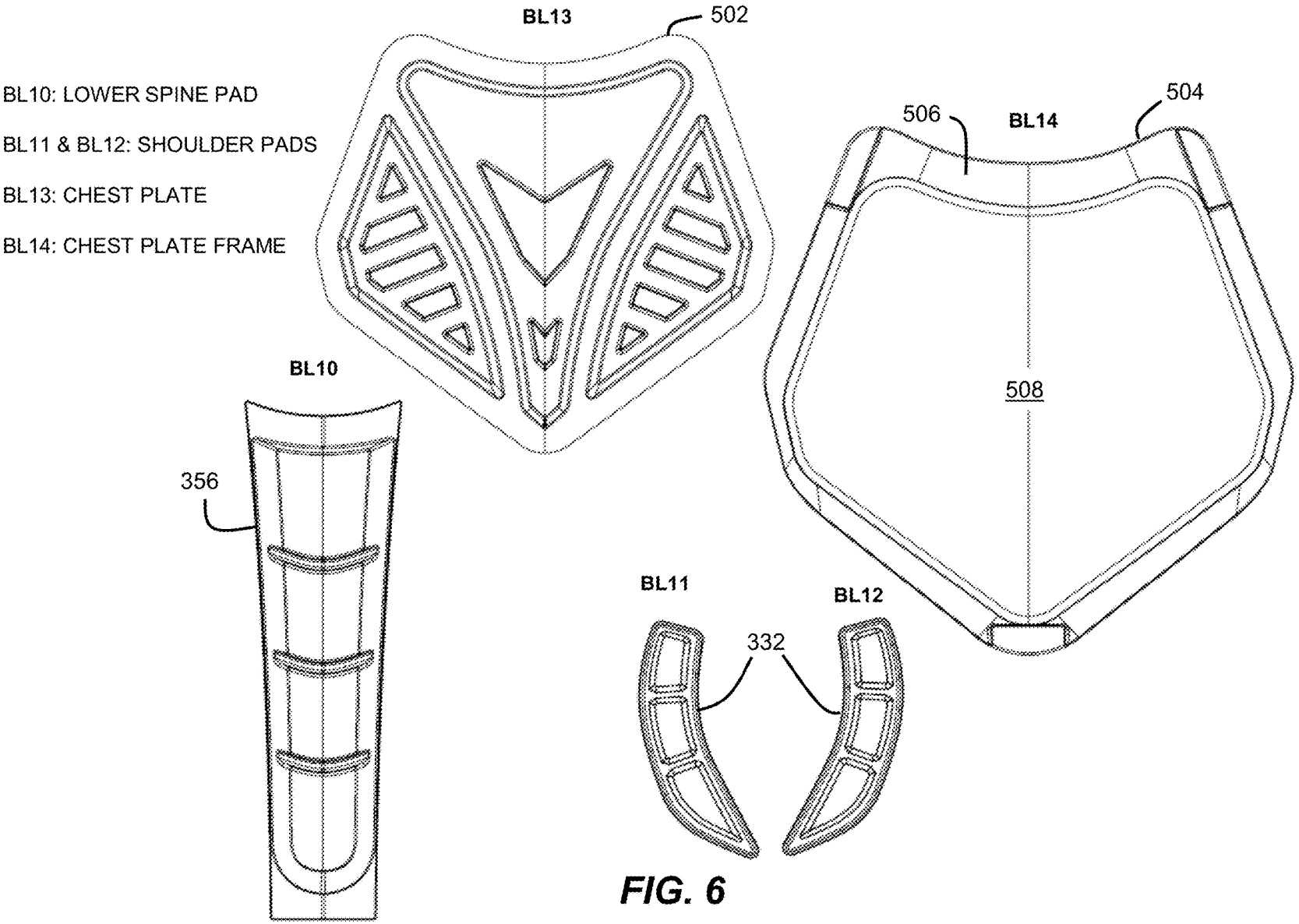
FIG. 6 is a schematic diagram that illustrates embodiments of molded parts of a pad system.

Compressible substrate 504 may be a compression foam, and may be formed as a frame in which outer protective layer 502 is mounted, as shown in FIGS. 5 and 6. Compressible substrate 504 may be molded foam, such as a cold compressed elastomeric polymer. In embodiments, compressible substrate 504 may be ASKER C 50 Durometer EVA (ethylene-vinyl acetate) or cold compressed ASKER C 35 Durometer EVA. In embodiments, layer 502 and substrate 504 may be molded separately and then assembled together, for example, by pressing and gluing the layer 502 into the frame of the substrate 504.

In embodiments, compressible substrate 504 may have a thickness 501 within a range of about 3 mm to about 15 mm, a density within a range of about 0.02 g/cm$^3$ to about 0.25 g/cm$^3$, and a Shore A hardness within a range of about 10 to about 40. In one implementation, the thickness of compressible substrate 504 may be about 5 mm. In embodiments, outer protective layer 502 may have a thickness 505 within a range of about 1 mm to about 5 mm, a density within a range of about 0.75 g/cm$^3$ to about 1.4 g/cm$^3$, and a Shore D hardness within a range of about 20 to about 55. In one implementation, the thickness of outer protective layer 502 may be about 2.95 mm.

Chest pad 300 may be sized and shaped to provide impact protection over a chest of a user, including, for example, over the locations 102, 104, 106 shown in FIG. 2. Sizes may be chosen based on the desired level of impact protection, and on the intended user of a pad system, such as a child size or an adult size. For example, in a pad system intended to be worn by adults and to meet the NOCSAE chest protection standards, a chest pad 300 may be approximately 5 mm thick and, when viewed from a front view, may have a width 511 of approximately 178 mm and a height 513 of approximately 178 mm, with the substrate 504 having those dimensions, and with the protective layer 502 inset within the substrate 504 and having a width 515 of approximately 158 mm, a height 517 of approximately 145 mm, and a major thickness 505 of approximately 2.95 mm. As shown in FIGS. 5-8, substrate 504 may have a frame portion 506 defining a recessed area 508 configured to receive the protective layer 502. In embodiments, frame portion 506 may have a thickness 507 of about 8 mm, or about 3 mm thicker than thickness 501. In embodiments, recessed area 508 may be sized and shaped substantially the same as the size and shape of protective layer 502, which may promote a secure fit between the components and may prevent the protective layer 502 from moving relative to or detaching from the substrate 504. As shown in the side and cross-sectional views of FIGS. 7 and 8, the frame 506 of substrate 504 may define a recess 508 having a depth of approximately 3 mm, and the protective layer 502 may have a thickness of about 2.95 mm, so that the major thickness 505 of the protective layer 502, excluding any protrusions from the outer face of the protective layer 502, allows the outer face of the protective layer 502 to be substantially flush with the outer surface of the frame 508 of the substrate 504. And, from of a front view, the protective layer 502 may have a shape substantially similar to the shape of the recessed area 508, and may have a size slightly smaller than, equal to, or slightly larger than the recessed area 508, so that the protective layer 502 may fit snugly within the frame 506 defining the recessed area 508. In embodiments, protective layer 502 may be held in the recessed area 508 by, for example, an adhesive, a fastener, stitching, and/or an interference fit or friction fit with the frame 506.

In alternative embodiments, the dimensions of substrate 504 and protective layer 502 may vary to accommodate different applications depending on, for example, a user's size, a desired impact protection, or a desired area of the body to protect.

Figure 8:
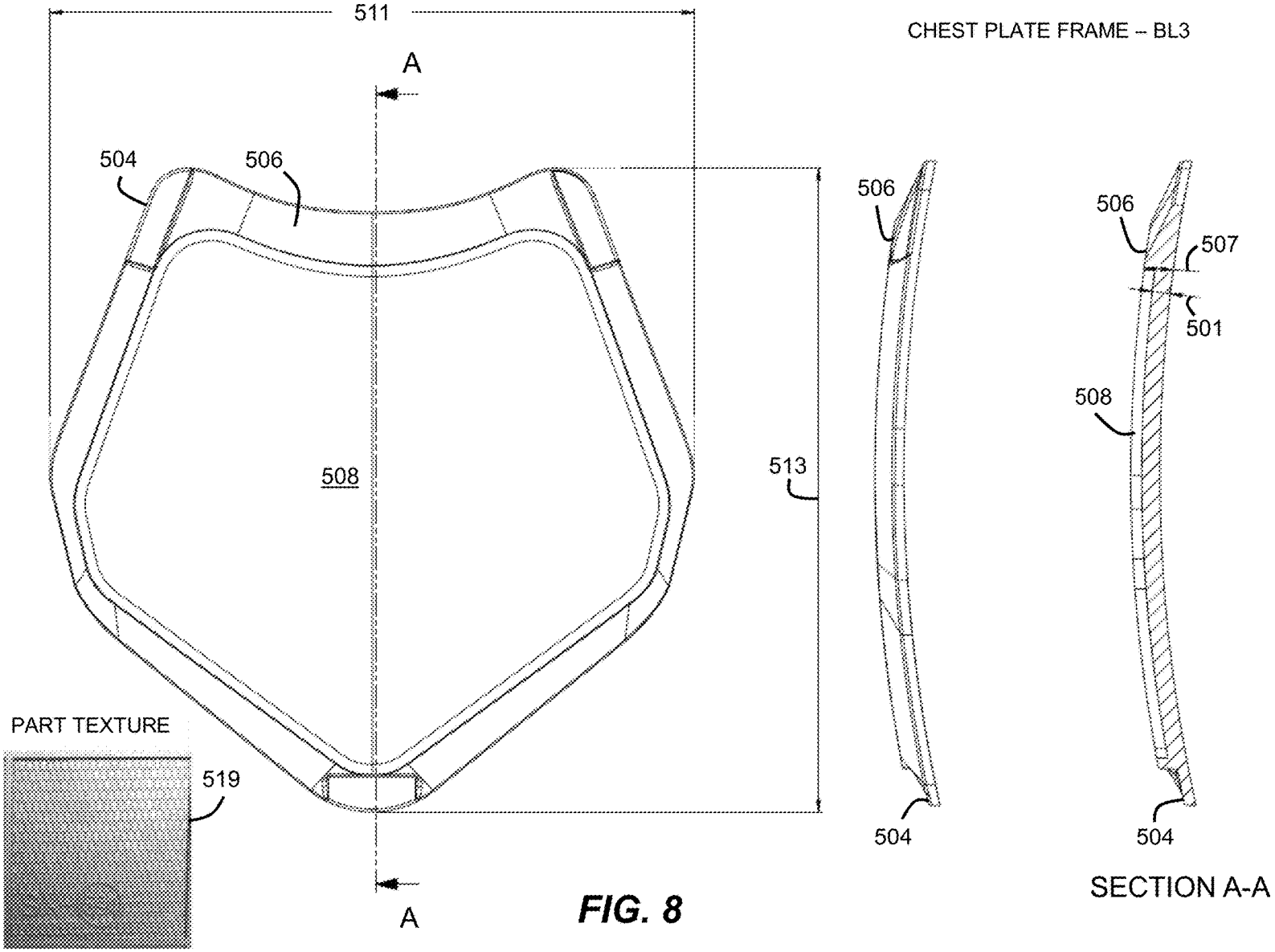
FIG. 8 is a schematic diagram that illustrates an embodiment of a compressible substrate of a chest pad.

In an embodiment, substrate 504 may be formed with a textured outer surface, an example 519 of which is shown in FIG. 8.

Figure 7:
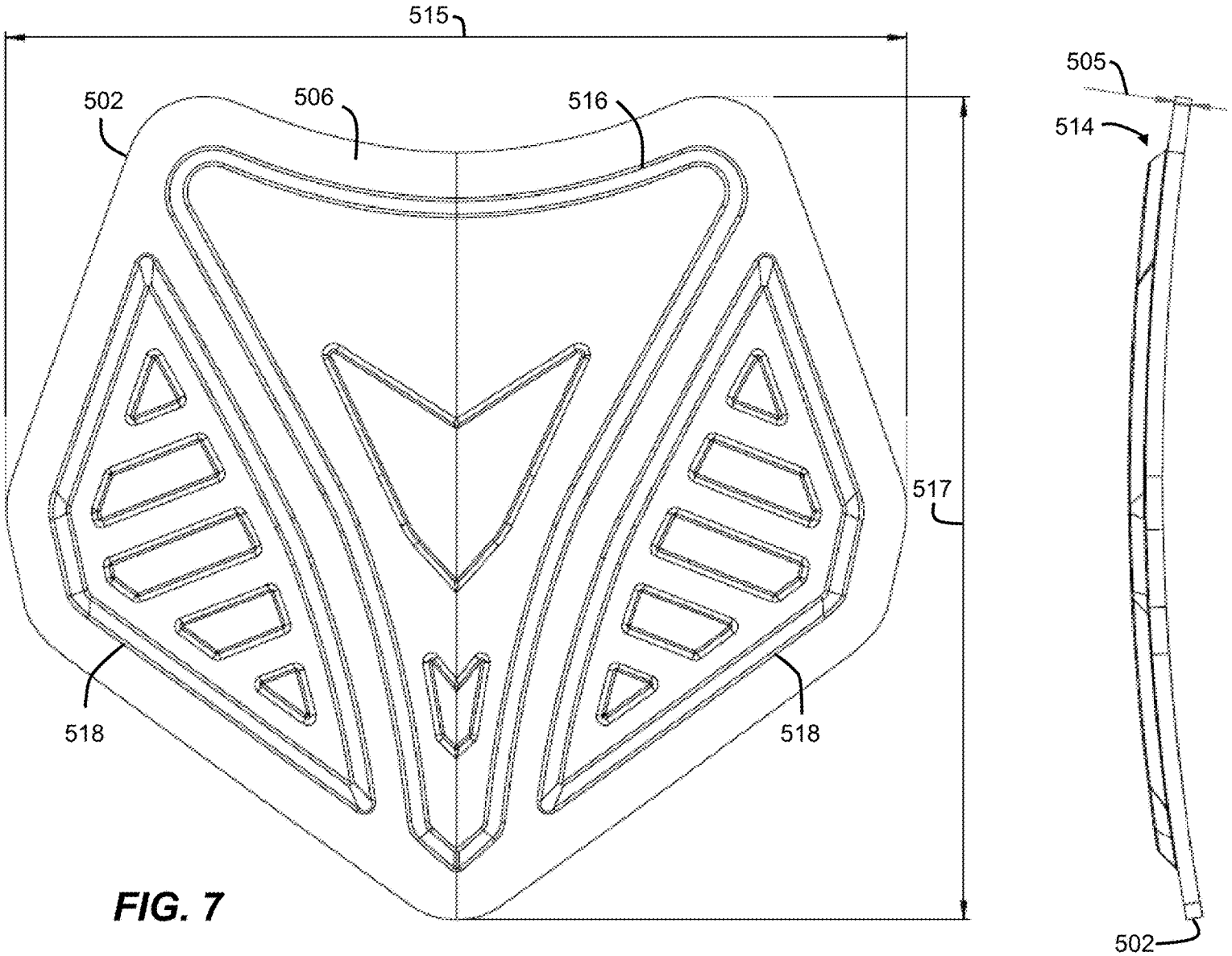
FIG. 7 is a schematic diagram that illustrates an embodiment of an outer protective layer of a chest pad.

Outer protective layer 502 may also include additional provisions for impact protection. As shown in FIG. 7, for example, embodiments may include protrusions 514, which extend from the major thickness 505 of the layer 502, and which are configured to extend out of the recessed area 508 of the substrate 504. As shown in the front view of FIG. 7, protrusions 514 may be shaped and aligned to provide additional cushioning for vulnerable portions of the chest, such as the sternum and rib cage. Protrusions 514 may include a sternum protrusion 516 and rib protrusions 518, which each provide additional thicknesses of compressible material over those vulnerable portions of the chest.

In addition, protrusions 514 may increase rigidity of the outer protective layer 502 to enhance impact protection. In embodiments, to increase strength and rigidity, protrusions 514 may define ribs, grooves, textures, or corrugation, examples of which are described in more detail below.

In covering an area, chest pad 300 and its protective layer 502 and substrate 504 may have a round, polygonal, or natural shape. For example, chest pad 300 may be circular or may be square. In embodiments, the shape of the chest pad may be configured to cover specific locations, while also allowing for movement of the user. The shape of chest pad 300 may therefore accommodate contours and parts of a user's body to allow such movement. One implementation may have a generally five-sided chest pad 300, when viewed in a front view, as shown in FIGS. 5-8. One or both of protective layer 502 and compressible substrate 504 may have the generally pentagonal shape. As shown, a corner of the pentagonal shape may be positioned at a lower, middle portion of the user's torso, and an opposing side of that corner may be positioned adjacent to the neck of the user. The opposing side may be curved so as to fit the form of the neck and collarbone of the user. This positioning of the pentagonal shape may also allow the left and right corners of the chest pad to extend across the chest of the user and cover critical areas of the chest (e.g., locations 102, 104, 106 and impact area 202 of FIG. 2), while also permitting convenient movement of the user's arms, lower torso, and hips.

Embodiments of chest pad 300 may also include provisions for meeting industry-accepted impact protection standards, while also providing a wearer with comfort and flexibility. Embodiments may therefore shape the chest pad 300 to enhance impact protection, while also fitting the form of a wearer. As shown in FIGS. 7 and 8, embodiments may provide a protective layer 502 and a substrate 504 that are curved in the vertical direction (or y-direction), or top to bottom in FIGS. 7 and 8. In other words, when positioned over the chest of a user, the chest pad 300 may curve outwardly (convex with respect to the user) over the impact area 202 (see FIG. 2), with the upper and lower portions of the chest pad 300 closer to the body and the middle portion of the chest pad farther from the body. The side and cross-sectional views of FIGS. 7 and 8 illustrate an example of a curved configuration. In embodiments, protective layer 502 and substrate 504 may have substantially the same radius of curvature so that layer 502 continuously contacts the substrate 504 and/or so that protective layer 502 may nest with a frame defined by substrate 504. Protective layer 502 and substrate 504 may have a radius of curvature in the y-direction within a range of about 265 mm to about 665. In implementations, protective layer 502 may have a radius of curvature in the y-direction of about 427 mm and substrate 504 may have a radius of curvature in the y-direction of about 427 mm.

Referring to FIGS. 3 and 4, as described above, front portion 304 of pad system 302 may include a base portion 312 on which chest pad 300 is flexibly mounted. In the chest pad area 316 underneath chest pad 300, base portion 312 may include an outer layer of knit polyester, an inner layer of hex spacer mesh material, and an intermediate foam layer between the inner and outer layers. The intermediate layer may be, for example, a layer of polyurethane foam, such as 35 mm polyurethane foam. The outer layer, inner layer, and intermediate foam layer may provide a soft, cushioning layer on which to mount the chest pad 300, and thereby furnish the user with additional comfort. In addition, the intermediate foam layer, along with the outer protective layer 502 and the compressible substrate 504, may provide a three-layer stack up that meets industry-accepted impact protection standards, while providing a user with comfort and freedom of movement.

As shown in FIGS. 3 and 4, other portions of the front portion 304 may provide protection at other locations of the user's body and may include provisions for securing the components to each other and to the body of the user. In an embodiment, front portion 304 may include shoulder portions 318 having an outer portion 320 and an inner portion 322. The inner portion 322 may lay under collarbone pads 314, and may include an outer layer of hex spacer mesh material and an inner layer of hex spacer mesh material. The outer portion 320 may include an outer compressible foam layer mounted on a substrate layer of textured polyurethane, an inner layer of hex spacer mesh material, and an intermediate foam stack up between the inner layer and the substrate layer. As shown in isolation in FIGS. 6 and 9, the outer compressible foam layer may be a molded foam part 332, e.g., cold compressed ASKER C 50 Durometer EVA. As shown in FIG. 9, molded foam part 332 may be curved in both the front views and the side views, to better conform to the contours of a user's shoulder, and may define lateral grooves 334 to increase flexibility. The intermediate stack up may be, for example, an outside layer of EVA foam (e.g., 3 mm ASKER C 50 Durometer EVA foam) and an inside layer of EVA foam (e.g., 7 mm ASKER C 20 Durometer EVA foam). The outer layer, inner layer, and intermediate foam stack up of outer portion 320 may provide impact protection for the outer portions of a user's shoulders.

As shown in FIG. 4, front portion 304 may also include pectoralis portions 324 configured to cover and protect pectoralis regions between the shoulder portions 318 and the chest pad area 316. The pectoralis portions 324 may include an outer layer of stretchable material (e.g., stretchable mesh), an inner layer of hex spacer mesh material, and an intermediate foam stack up between the inner and outer layers. The intermediate stack up may be, for example, an outside layer of polyethylene ("PE") foam (e.g., 3 mm ASKER C 50 Durometer PE foam with a perforated pattern) and an inside layer of EVA foam (e.g., 7 mm ASKER C 20 Durometer EVA foam). The outer layer, inner layer, and intermediate foam stack up of pectoralis portions 324 may provide impact protection for the upper and side pectoral regions of a user's torso.

As shown in FIG. 4, front portion 304 may also include a lower portion 328 configured to cover and protect the rib cage and stomach of a user. The lower portion 328 may include an outer layer of hook-and-loop fastener material (e.g., Velcro®), an inner layer of hex spacer mesh material, and an intermediate foam stack up between the inner and outer layers. The intermediate stack up may be, for example, an outside layer of EVA foam (e.g., 3 mm ASKER C 50 Durometer EVA foam) and an inside layer of EVA foam (e.g., 7 mm ASKER C 20 Durometer EVA foam). The outer layer, inner layer, and intermediate foam stack up of outer portion 328 may provide impact protection for the lower rib cage, stomach, waist, and hips of a user. The outer layer of lower portion 328 may also provide means for fastening the front portion 304 to the back portion 306, and for securing the pad system 302 to a user. For example, as represented in FIG. 4, elastic waist straps 330 having hook-and-loop fasteners may be attached to the back portion 306 and pulled around to the front portion 304 to be affixed at any location within the hook-and-loop fastener material of the outer layer of the lower portion 328. Straps 330 may include, for example, an elastic band (e.g., 38 mm wide elastic band) and a hook-and-loop tape end portion. Alternative embodiments may use other fastening means, such as buckles, snaps, or ties.

In embodiments, collarbone pads 314 may include multiple layers, to provide soft, cushioning, protection for a user's collarbone. For example, collarbone pads 314 may include an outer layer of stretchable material (e.g., stretchable mesh) and/or textured polyurethane, an inner layer of hex spacer mesh material, and an intermediate foam stack up between the inner and outer layers. The intermediate stack up may be, for example, an outside layer of polyethylene foam (e.g., 3 mm ASKER C 50 Durometer PE foam with a perforated pattern) and an inside layer of EVA foam (e.g., 7 mm ASKER C 35 Durometer EVA foam).

As shown in FIGS. 3 and 4, back portion 306 may include a base portion 350 (which may also be referred to as a back vest), left and right back pads 352, a top spine pad 354, and a lower spine pad 356.

Figure 17:
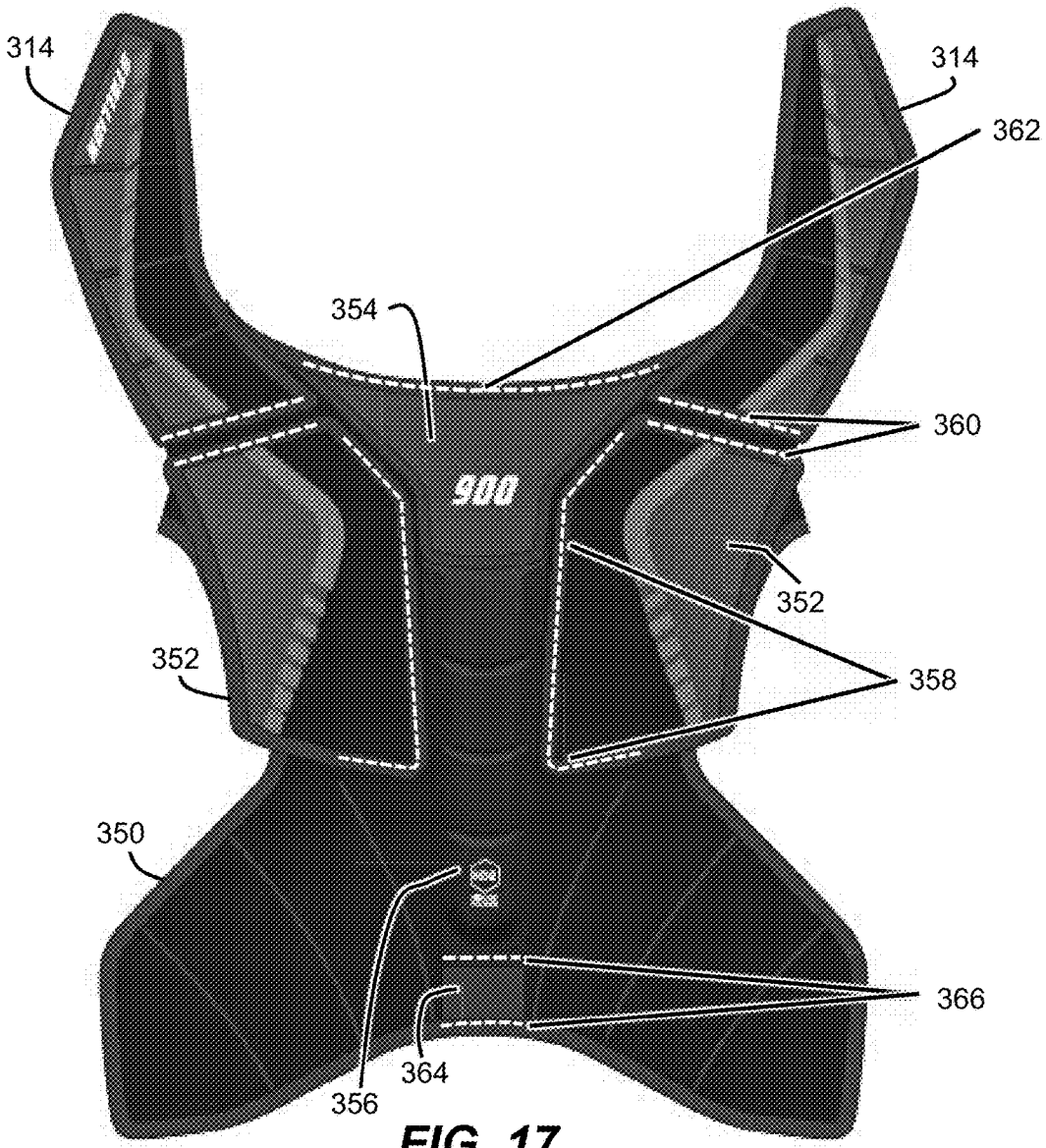
FIG. 17 is a schematic diagram that illustrates an embodiment of assembled back and shoulder portions of a pad system.

Base portion 350 of back portion 304 may be configured to cover a majority of a user's back and to provide a base on which to mount the remaining components of the back portion 306. In embodiments, back pads 352 may be attached (e.g., by stitching or adhesive) to the base portion along the inside edge and halfway along the bottom edge, as represented by the dashed lines 358 in FIG. 17. This attachment configuration may allow the outside edges of the back pads 352 and base portion 350 to flex, providing a user with comfort and ease of motion. Back pads 352 may also be attached to the collarbone pads 314, for example, by an elastic material such as a Lycra™ gusset, as represented by the dashed lines 360 in FIG. 17. In embodiments, the top of top spine pad 354 may be attached (e.g., by stitching or adhesive) to the top of the neck line of the base portion 350 as represented by the dashed line 362, while the bottom of top spine pad 354 may be attached to the base portion 350 and/or the lower spine pad 356. In embodiments, the lower spine pad 356 may be continuously attached to the base portion 350. Optionally, to provide a user with more ease of motion, lower spine pad may slide against or otherwise move independently of the base portion 350, being attached at its top to the top spine pad 354 and at its bottom to an elastic tab 364 that is attached to the bottom edge of the base portion 350, as represented by the dashed lines 366 in FIG. 17.

In the areas on which the left and right back pads 352, the top spine pad 354, and the lower spine pad 356 are positioned, base portion 350 may include an outer layer of hex spacer mesh material and an inner layer of hex spacer mesh material. In the waist area below the back pads 352 and the lower spine pad 356, base portion 350 may include an outer layer of stretchable material (e.g., stretchable mesh), an inner layer of hex spacer mesh material, and an intermediate foam stack up between the inner and outer layers. The intermediate stack up may be, for example, an outside layer of polyethylene foam (e.g., 3 mm ASKER C 50 Durometer PE foam with a perforated pattern) and an inside layer of EVA foam (e.g., 7 mm ASKER C 35 Durometer EVA foam). The outer layer, inner layer, and intermediate foam stack up of the waist area portion of the base portion 350 may provide impact protection for the lower rib cage, back, waist, and hips of a user. The outer layer of the waist area portion of the base portion 350 may also provide means for fastening the front portion 304 to the back portion 306, and for securing the pad system 302 to a user. For example, as represented in FIG. 4, elastic waist straps 330 having hook-and-loop fasteners may be attached to the waist area portion of the back portion 306 and pulled around to the front portion 304 to be affixed at any location within the hook-and-loop fastener material of the outer layer of the lower portion 328. Alternative embodiments may use other fastening means, such as buckles, snaps, or ties.

In embodiments, back pads 352 may include multiple layers, to provide soft, cushioning, protection for a user's back, such as the deltoids and shoulder blades. For example, back pads 352 may include an outer layer of stretchable material (e.g., stretchable mesh) and/or textured polyurethane, an inner layer of hex spacer mesh material, and an intermediate foam stack up between the inner and outer layers. The intermediate stack up may be, for example, an outside layer of polyethylene foam (e.g., 3 mm ASKER C 50 Durometer PE foam with a perforated pattern) and an inside layer of EVA foam (e.g., 7 mm ASKER C 35 Durometer EVA foam).

In embodiments, top spine pad 354 may include multiple layers, to provide soft, cushioning, protection for a user's upper back, including the upper spine. For example, top spine pad 354 may include an outer layer of stretchable material (e.g., stretchable mesh), an inner layer of hex spacer mesh material, and an intermediate foam stack up between the inner and outer layers. The intermediate stack up may be, for example, an outside layer of EVA foam (e.g., 3 mm ASKER C 50 Durometer EVA foam) and an inside layer of EVA foam (e.g., 7 mm ASKER C 20 Durometer EVA foam).

In embodiments, lower spine pad 356 may be molded of a compressible foam. As shown in isolation in FIGS. 6 and 9, the lower spine pad 356 may be a molded foam part, e.g., cold compressed ASKER C 50 Durometer EVA or cold compressed ASKER C 35 Durometer EVA. As shown in FIG. 9, the lower spine pad 356 may be curved in the side view, to better conform to the contours of a user's back, and may define lateral grooves 358 to increase flexibility.

Figure 10:
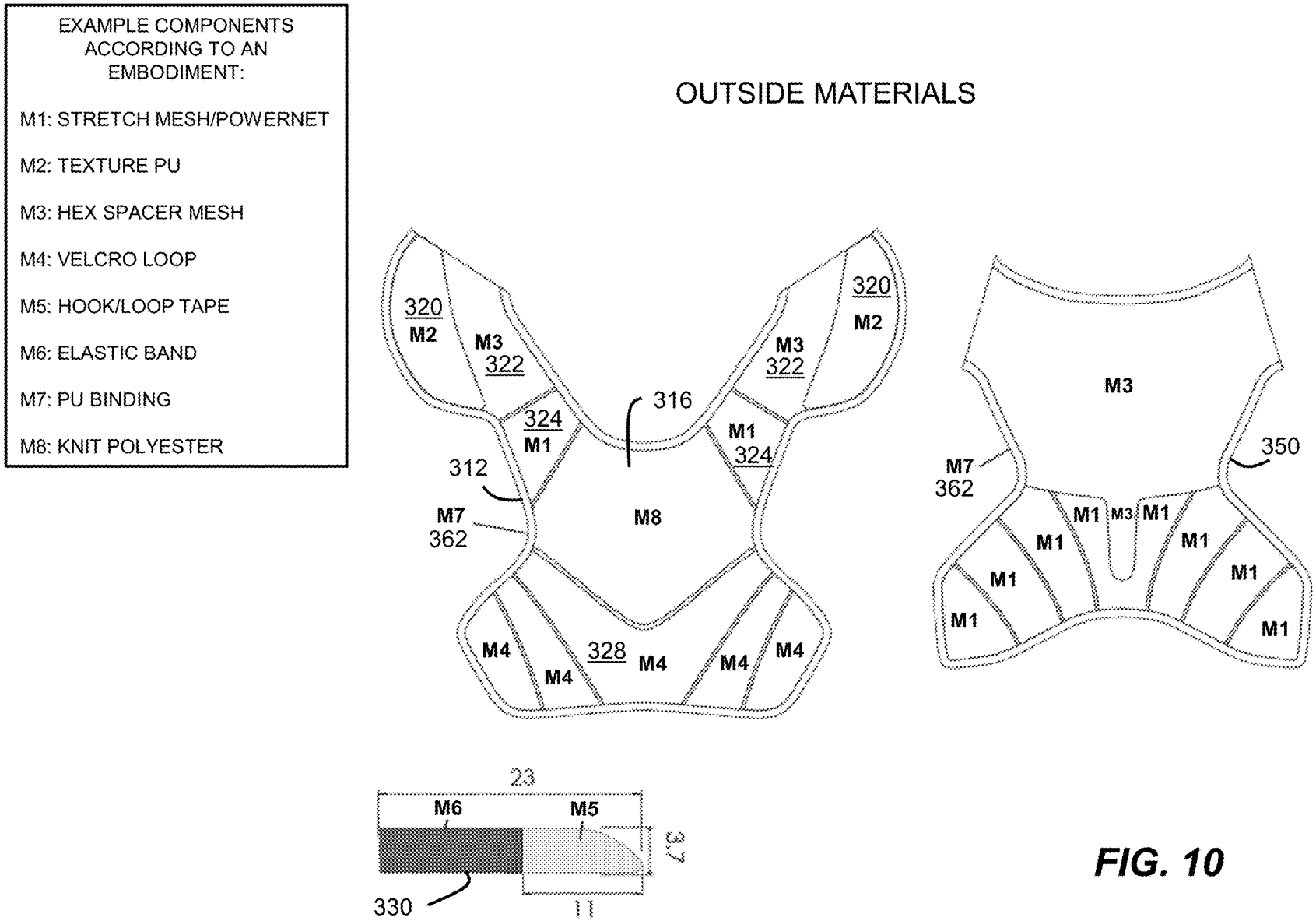
FIG. 10 is a schematic diagram that illustrates embodiments of outside materials of front and back portions (or vests) of a pad system.
Figure 11:
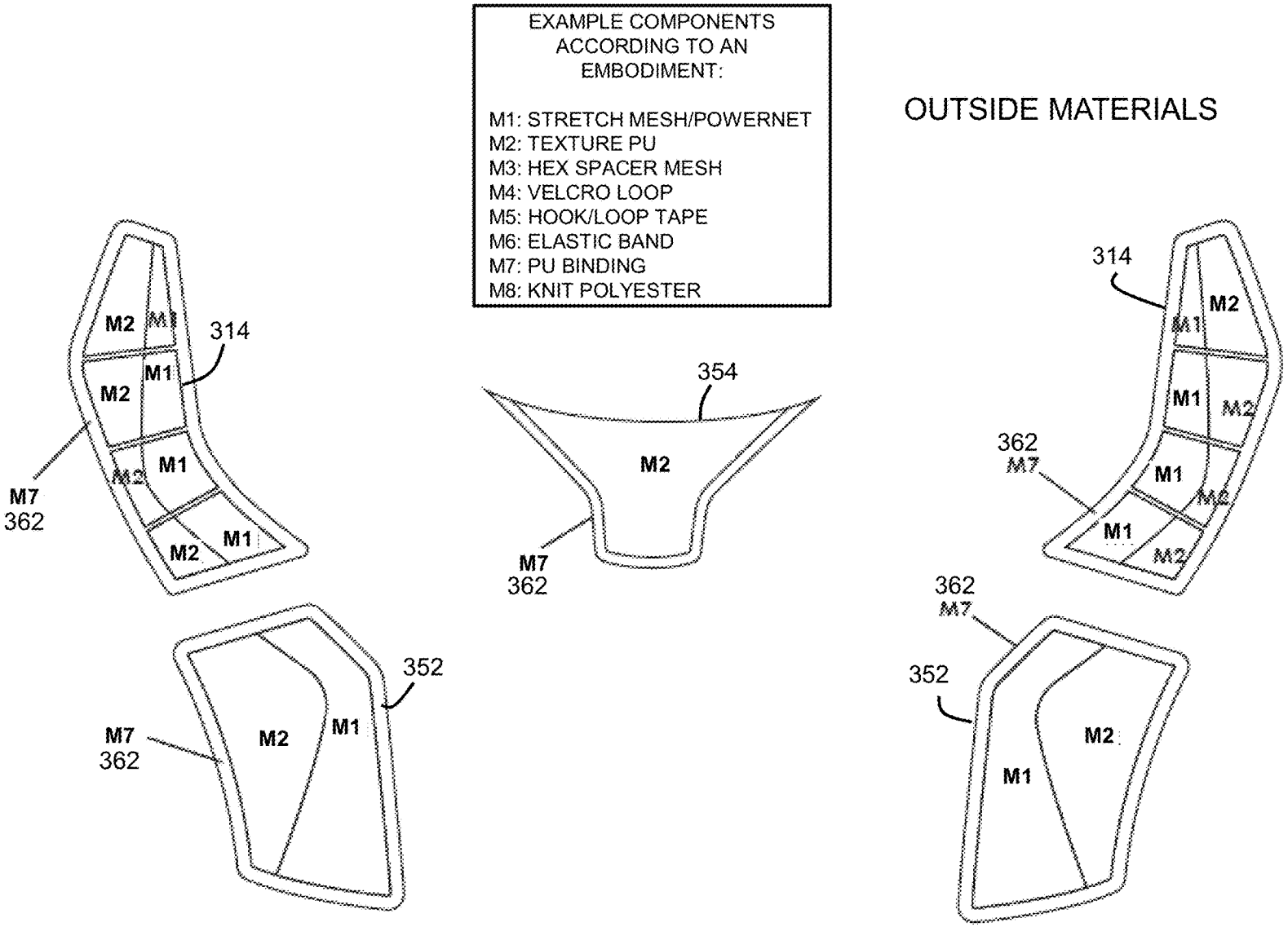
FIG. 11 is a schematic diagram that illustrates embodiments of outside materials of back and shoulder portions of a pad system.
Figure 12:
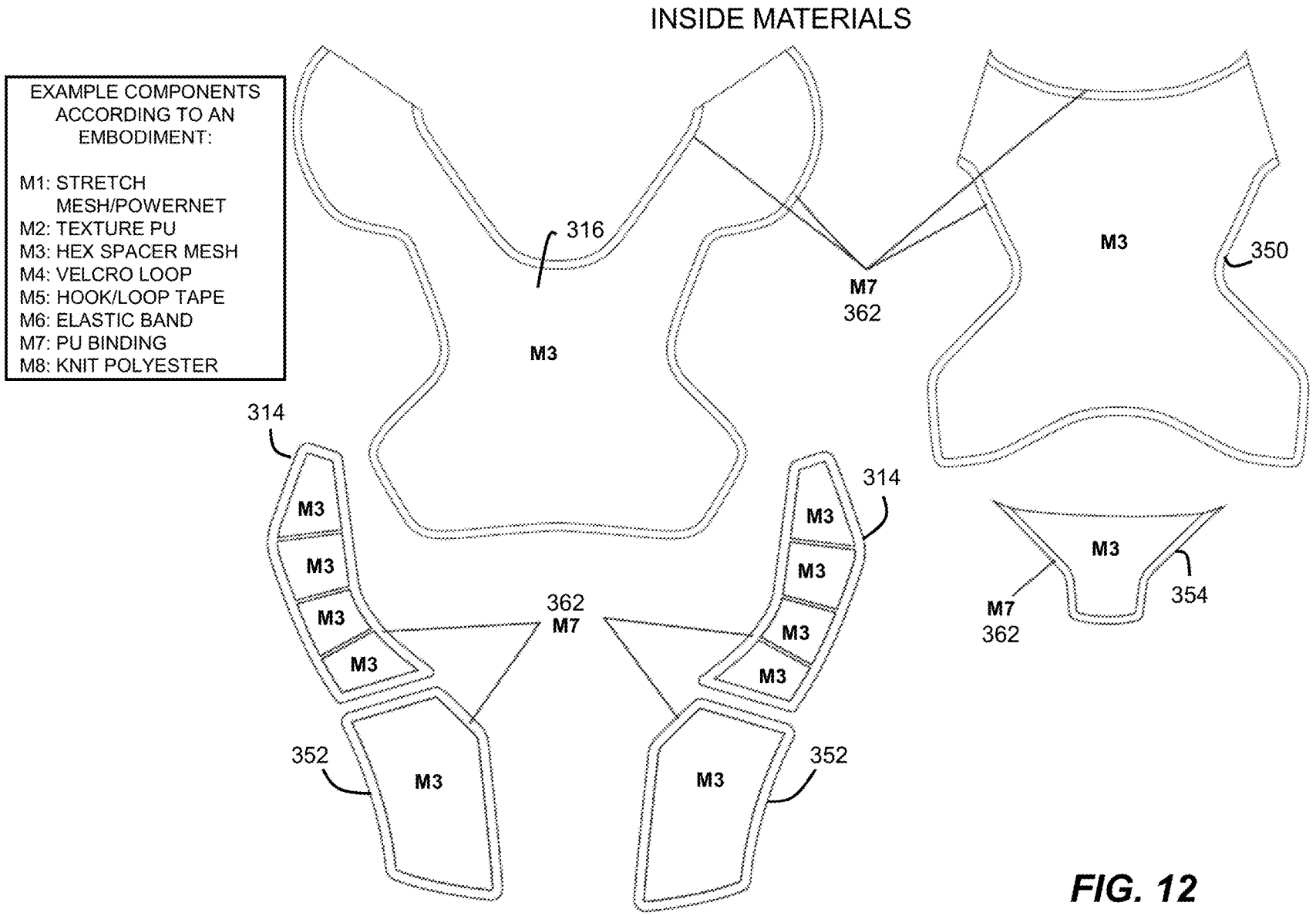
FIG. 12 is a schematic diagram that illustrates embodiments of inside materials of portions of a pad system.
Figure 15:
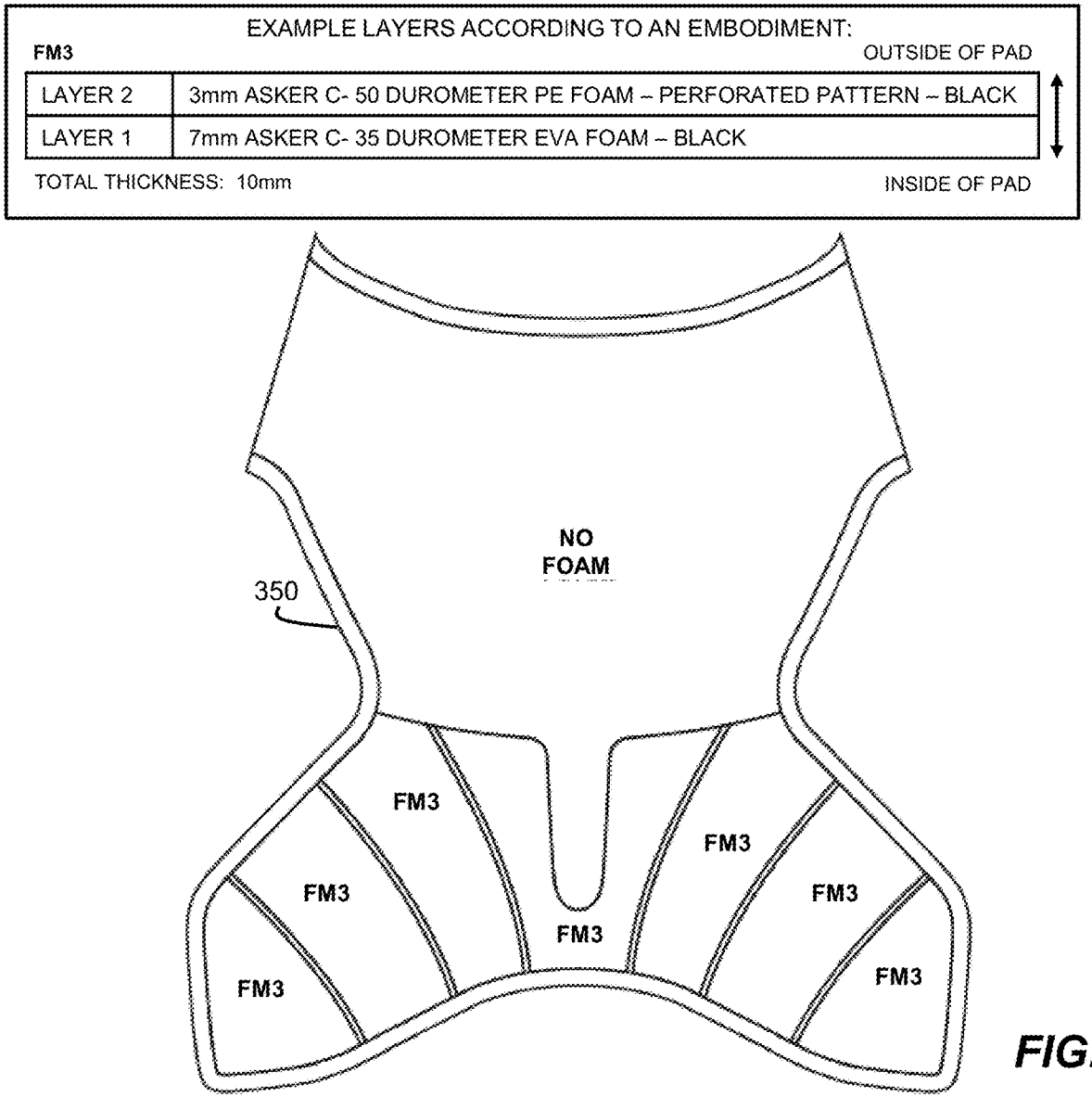
FIG. 15 is a schematic diagram that illustrates embodiments of foam stack ups of back and shoulder portions of a pad system.

As shown in FIGS. 10-12, components of a pad system 302 may have edge binding 362 to finish edges of a component and secure the layers together. Edge binding may be made of, for example, polyurethane.

Figure 18:
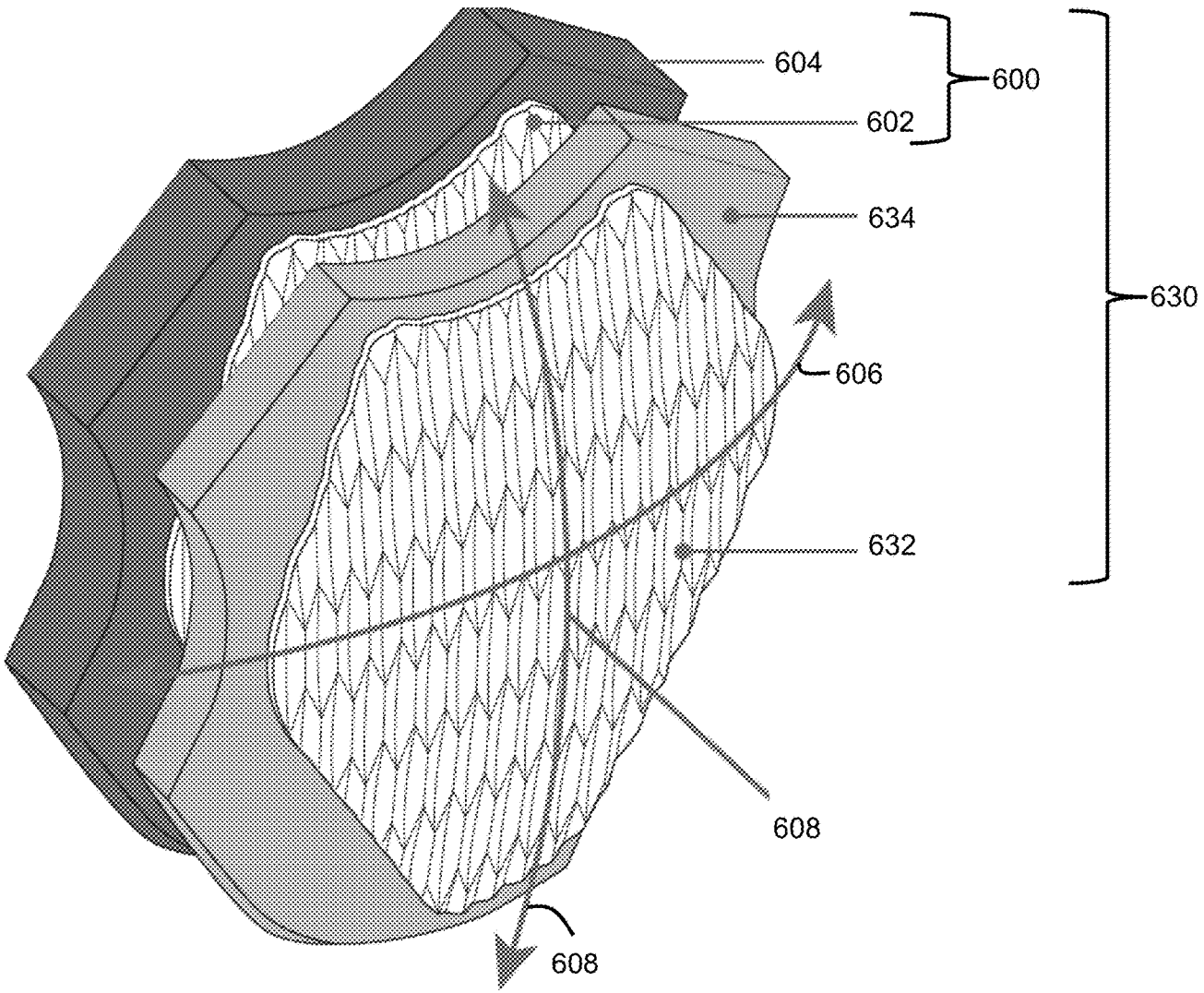
FIG. 18 is a schematic diagram that illustrates other embodiments of a body pad, which in the examples are chest pads.
Figure 19:
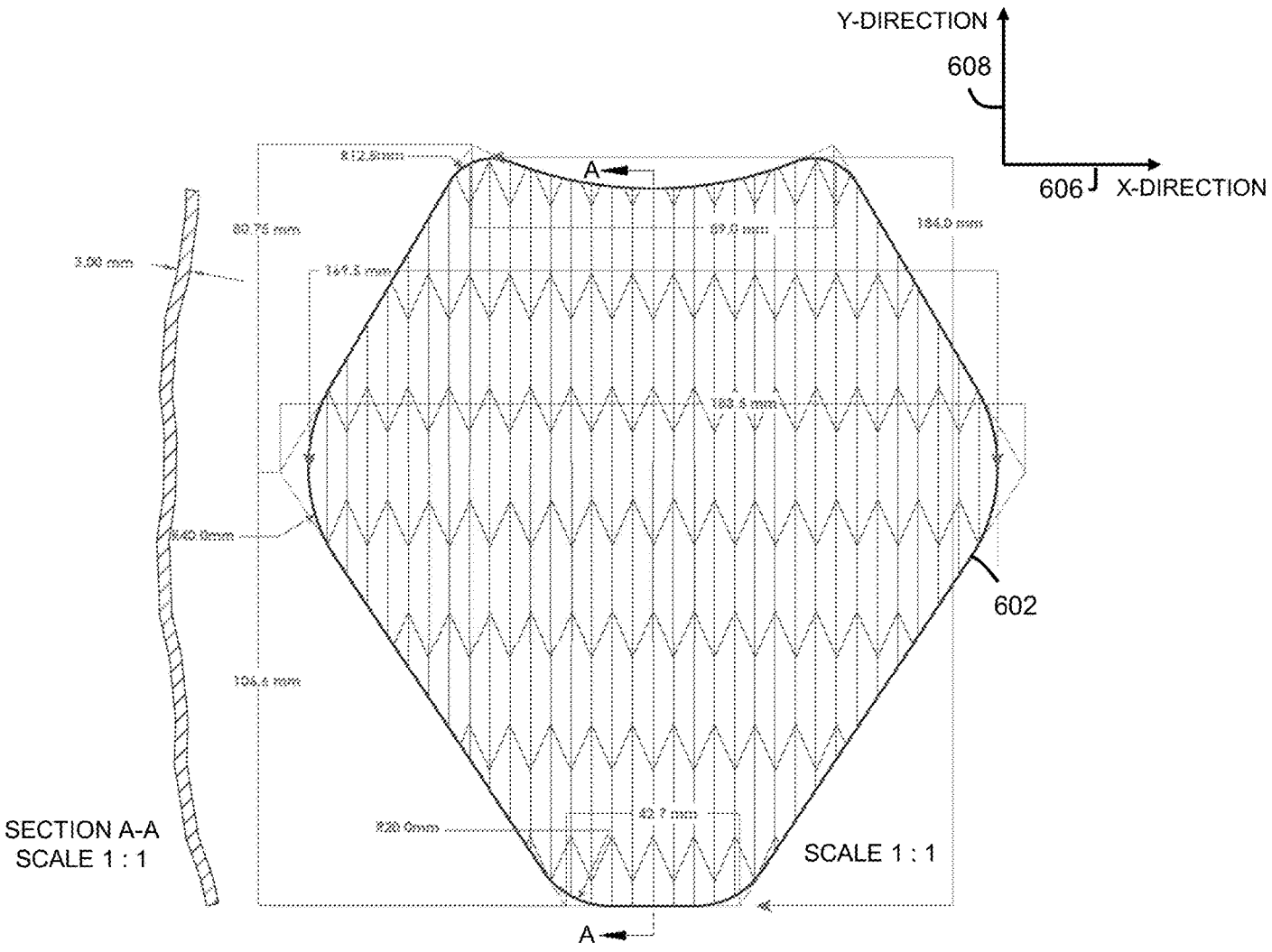
FIG. 19 is a schematic diagram that illustrates an embodiment of a protective layer of a chest pad.

FIGS. 18-25 illustrate another embodiment of a chest pad configured to provide impact protection, having a multilayer construction, with each layer providing a performance function. As shown in FIG. 18, an embodiment may provide a chest pad 600 having at least two layers, including a protective layer 602 mounted on a compressible substrate 604. While both layers may provide impact protection, substrate 604 may be more compressible, or softer, to provide a more comfortable contact with a user's body.

Protective layer 602 may be a corrugated plate, which may be textured and curved (compound curvature) in both the x- and y-directions as represented by arrows 606 and 608, respectively. In embodiments, protective layer 602 may have a thickness within a range of about 1 mm to about 5 mm, a density within a range of about 0.75 g/cm$^3$ to about 1.4 g/cm$^3$, and a Shore D hardness within a range of about 20 to about 55. In one implementation the thickness of protective layer 602 may be about 2.95 mm. Protective layer 602 may be molded polyethylene board, for example, 3.0 mm curved and textured polyethylene board.

In embodiments, compressible substrate 604 may have a thickness within a range of about 30 mm to about 65 mm, a density within a range of about 0.01 g/cm$^3$ to about 0.1 g/cm$^3$, and a Shore OO hardness within a range of about 0 to about 50. In one implementation, the thickness of compressible substrate 604 may be about 20 mm. Compressible substrate 604 may be a compression foam, for example, 20.0 mm polyurethane foam. In embodiments, layer 602 and substrate 604 may be molded separately and then assembled together, for example, by pressing and gluing the layer 602 onto substrate 604.

Chest pad 600 may be sized and shaped to provide impact protection over a chest of a user, including, for example, over the locations 102, 104, 106 shown in FIG. 2. Sizes may be chosen based on the desired level of impact protection, and on the intended user of a pad system, such as a child size or an adult size. For example, referring to FIGS. 18-19, in a pad system intended to be worn by adults and to meet the NOCSAE chest protection standards, a chest pad 600 may be approximately 23 mm thick and, when viewed from a front view, may be approximately 200 mm wide and approximately 200 mm high, with the substrate 604 having those dimensions, and with the layer 602 mounted on the substrate 604 and being approximately 170 mm wide, approximately 184 mm high, and approximately 3.0 mm thick.

In an embodiment, chest pad 600 may be configured to be worn on a chest of a user with the substrate 604 disposed closest to the user. When viewing the chest pad 600 from the z-direction (e.g., front view in FIG. 19), the chest pad 600 may define a concave upper edge configured to be disposed under a neck of the user and have a first end portion and a second end portion, a first side edge extending from the first end portion of the concave upper edge and angled outwardly with respect to the x-direction toward a first side obtuse corner portion, a second side edge opposite to the first side edge, extending from the second end portion of the concave upper edge and angled outwardly with respect the x-direction toward a second side obtuse corner portion apex, a third side edge extending from the first side obtuse corner portion and angled inwardly with respect to the x-direction, and a fourth side edge extending from the second side obtuse corner portion and angled inwardly with respect to the x-direction. This configuration may allow the chest pad 600 to extend across a chest of the user from the first side obtuse corner portion to the second side obtuse corner portion.

Figure 20:
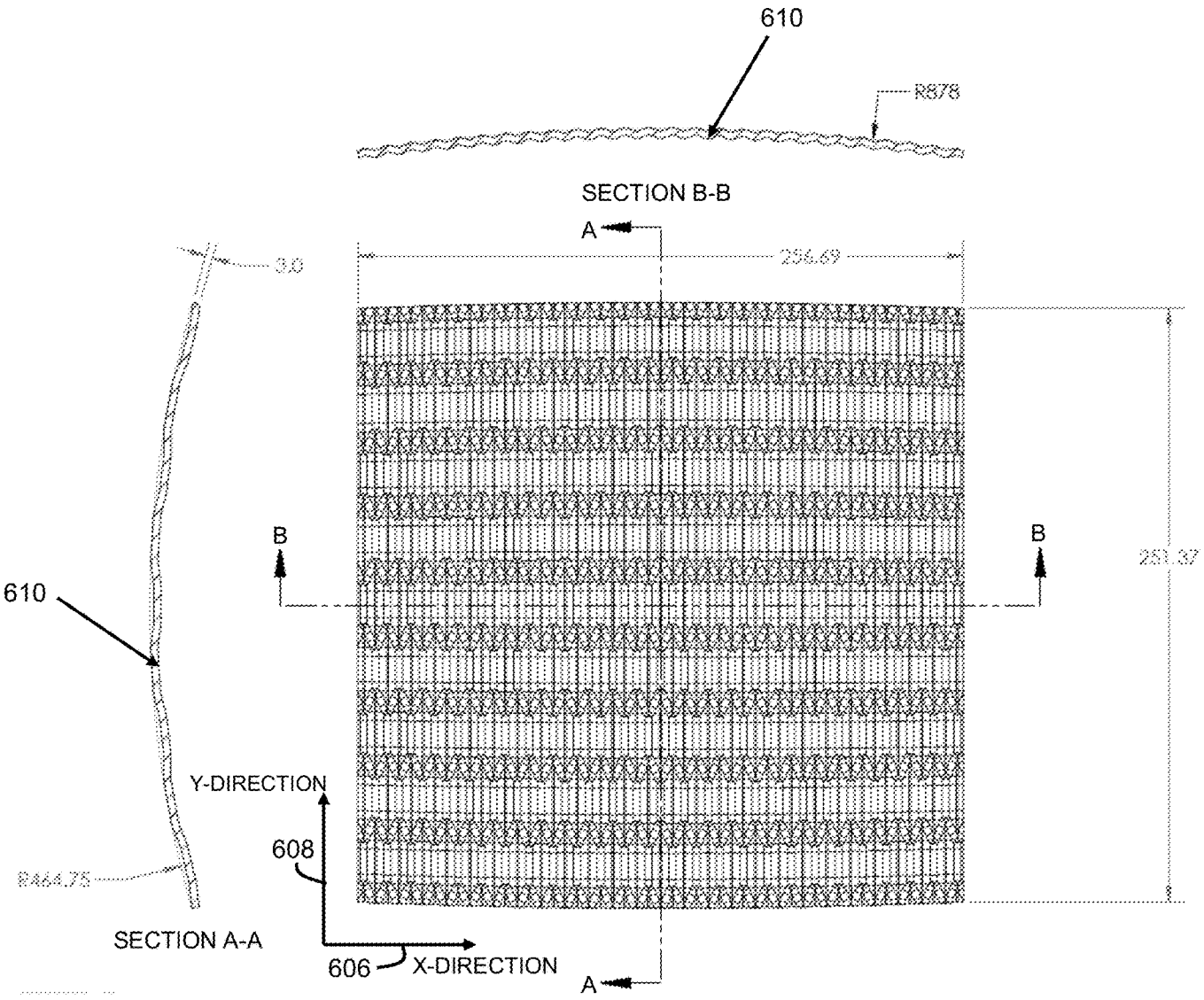
FIG. 20 is a schematic diagram that illustrates an embodiment of a blank from which to form a protective layer of a chest pad.
Figure 21:
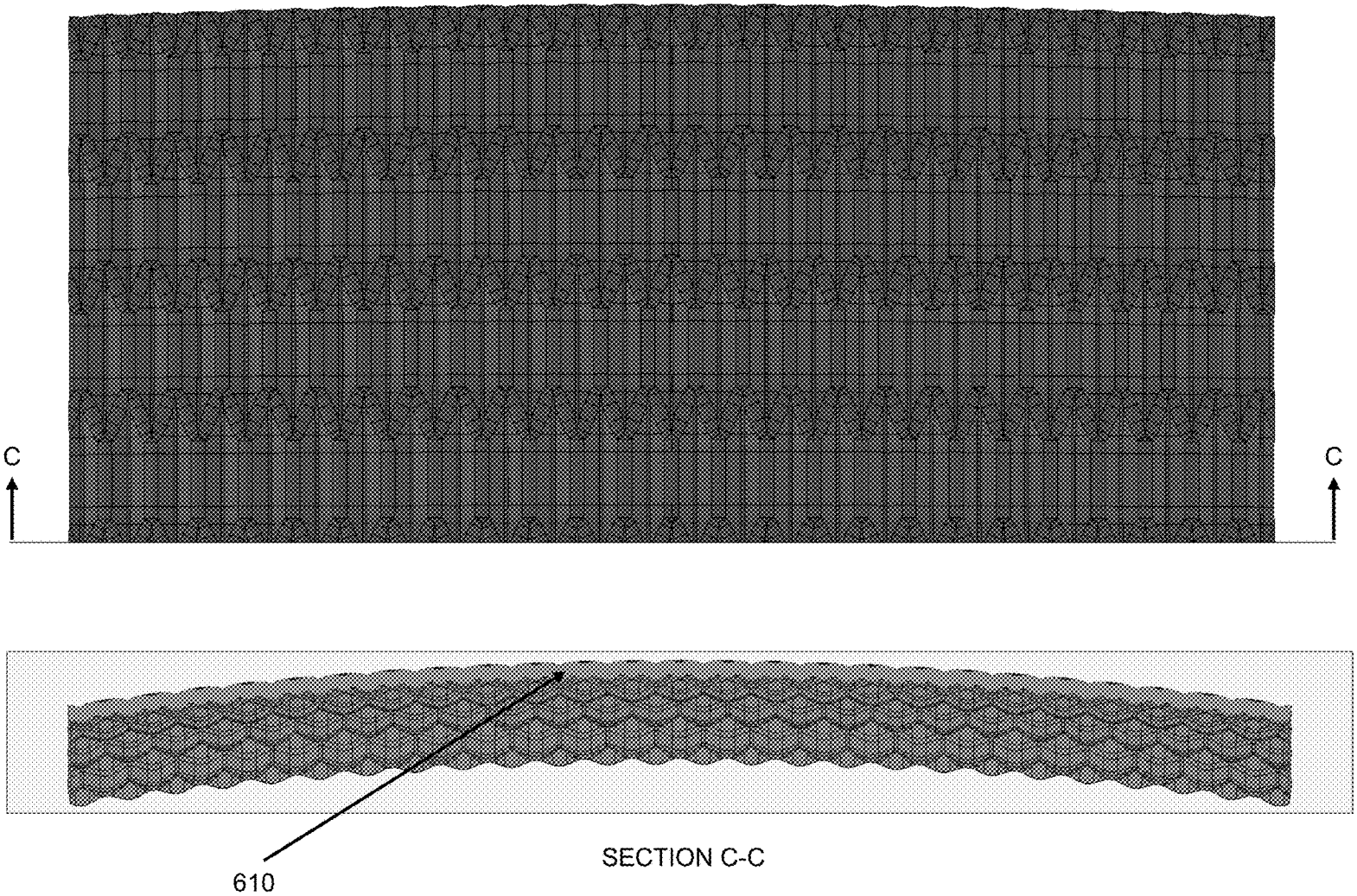
FIG. 21 is a schematic diagram that illustrates a cross-sectional view of the protective layer blank of FIG. 20, taken along line C-C in FIG. 21.

As shown in FIG. 20, layer 602 may be formed from a substantially square blank, for example, approximately 257 mm wide and 252 mm high. As shown in the cross-section A-A of FIG. 20, layer 602 may have a radius of curvature in the y-direction 608 within a range of approximately 265 mm to approximately 665 mm. In one implementation, the radius of curvature in the y-direction 608 is approximately 465 mm. As shown in the cross-section B-B of FIG. 20, layer 602 may have a radius of curvature in the x-direction 606 within a range of approximately 578 mm to approximately 1178 mm. In one implementation, the radius of curvature in the x-direction 606 is approximately 878 mm.

Figure 22:
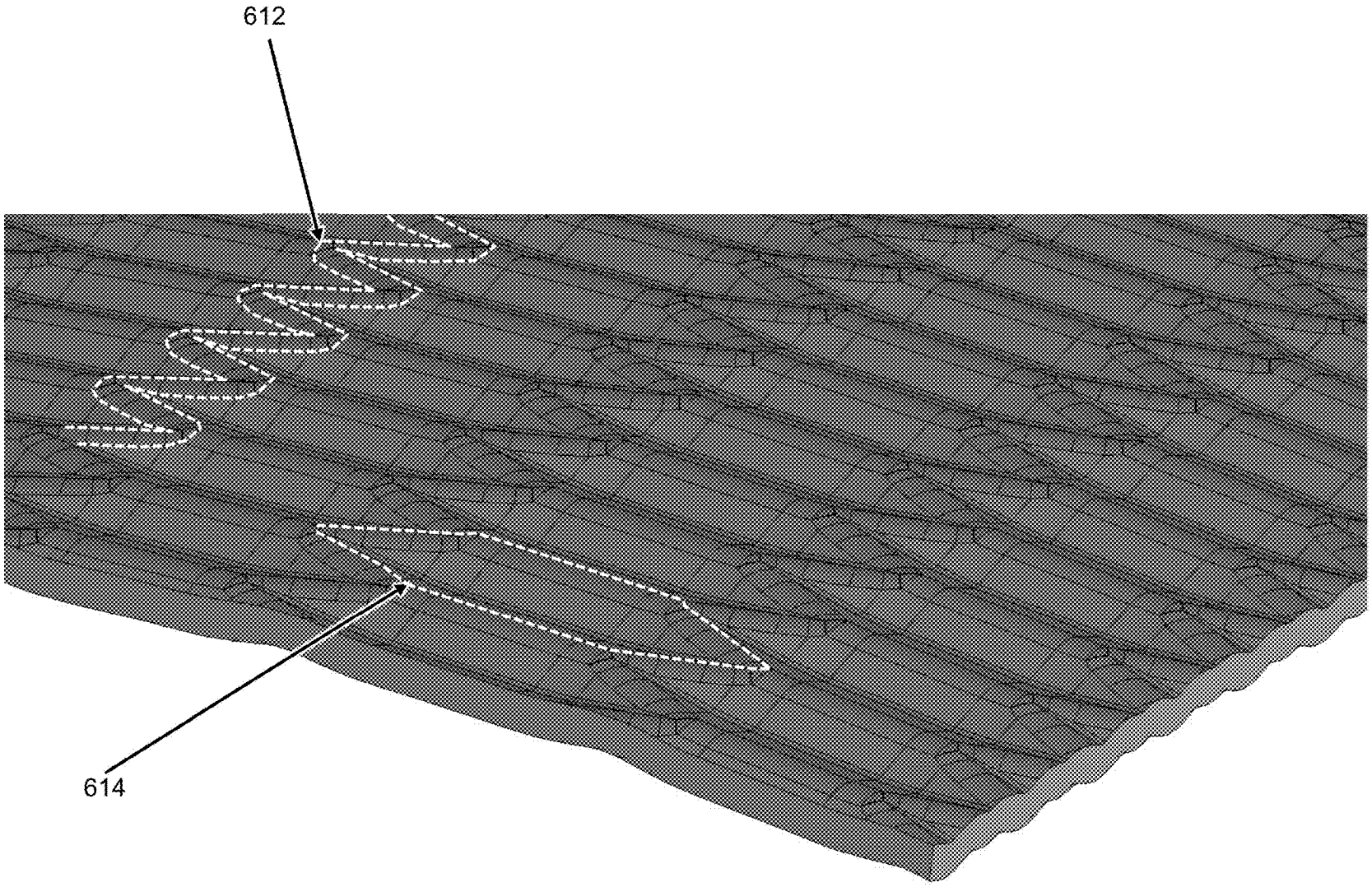
FIG. 22 is a schematic diagram that illustrates a perspective view of an embodiment of an outer corrugated surface of a protective layer.
Figure 23:
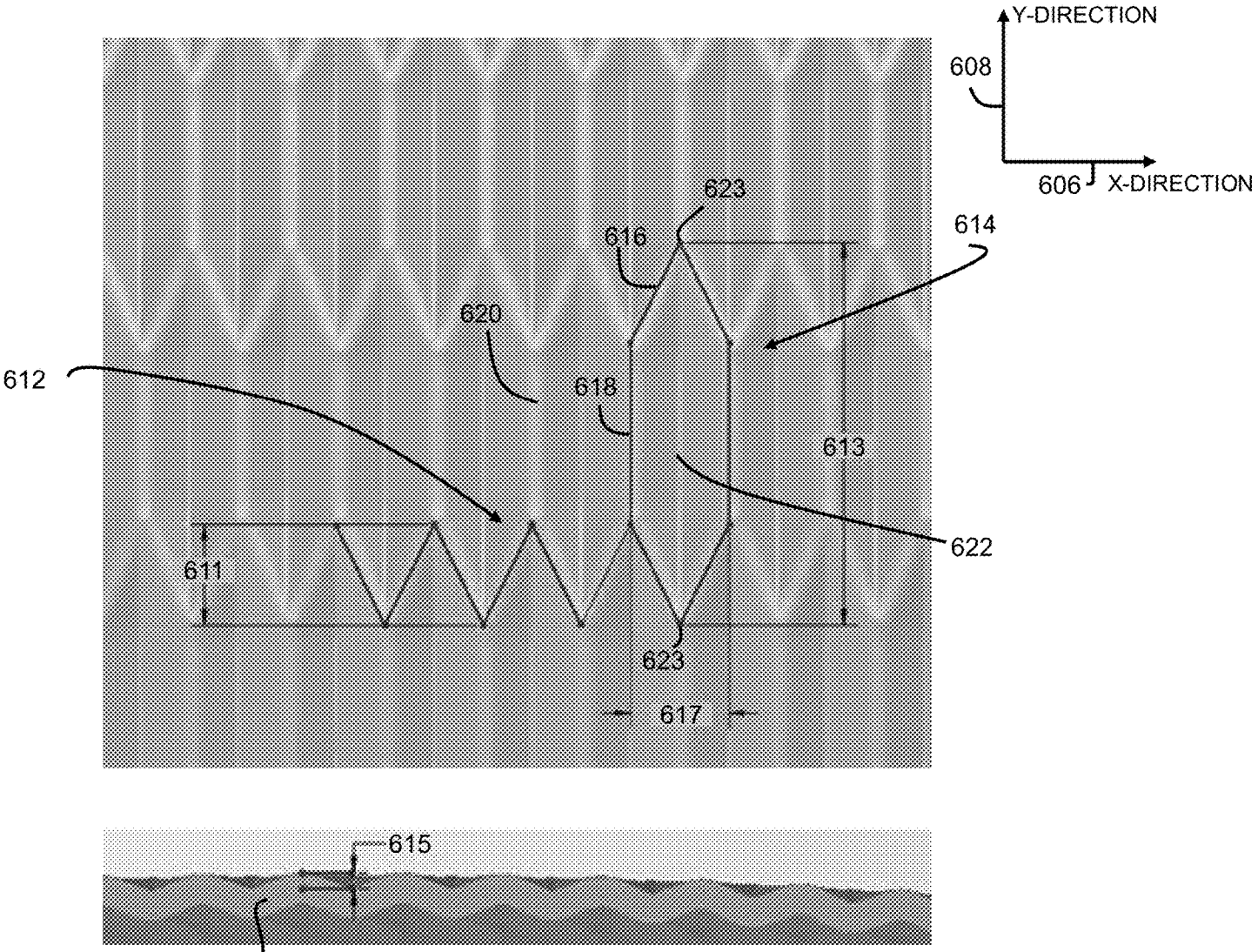
FIG. 23 is a schematic diagram that illustrates a front view of an embodiment of an outer corrugated surface of a protective layer.
Figure 24:
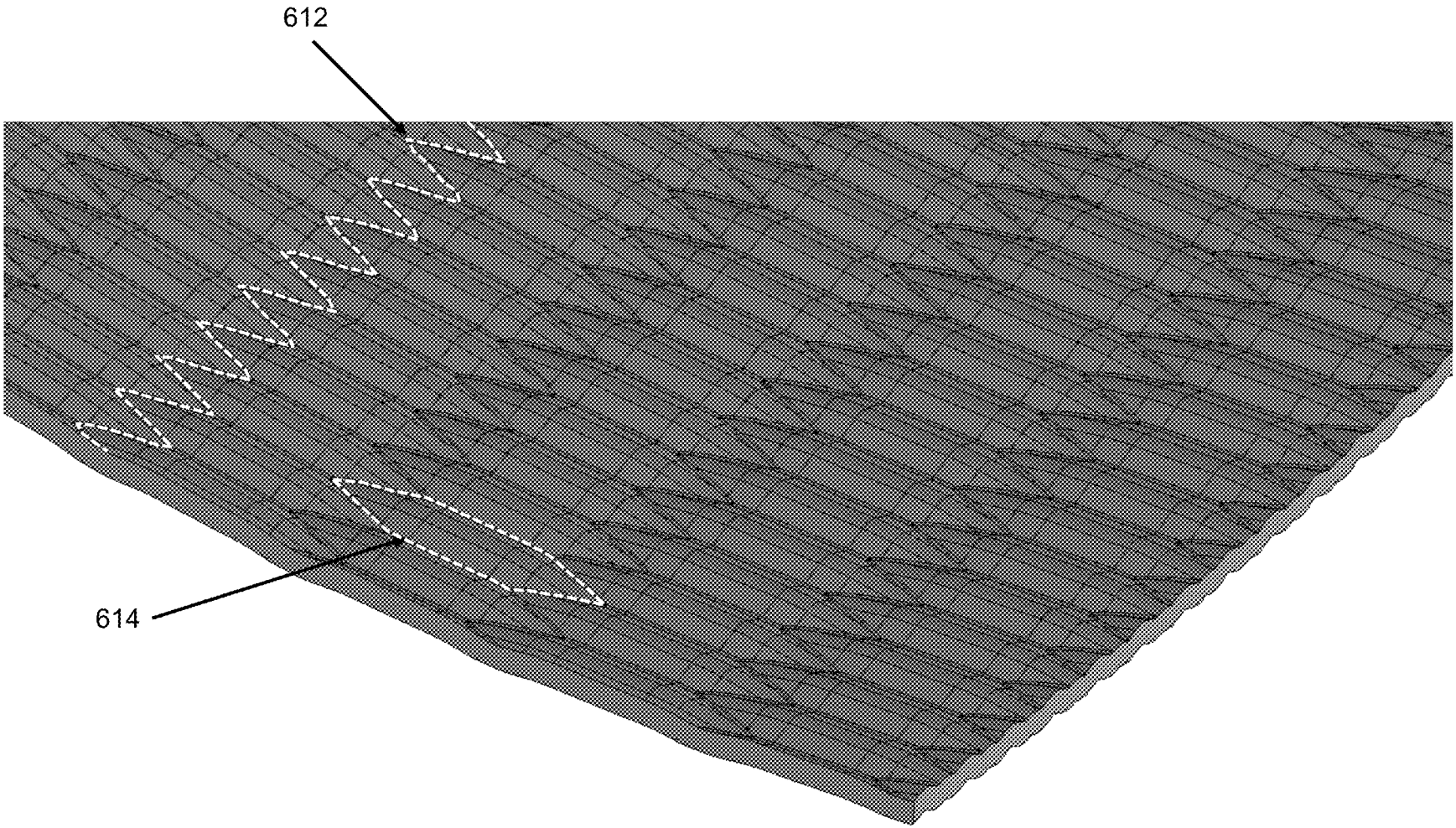
FIG. 24 is a schematic diagram that illustrates a perspective view of the inner corrugated surface of the protective layer of FIG. 22.

In embodiments, protective layer 602 may have a corrugated structure to increase stiffness and impact protection, while minimizing thickness and weight for enhanced comfort and wearability. As shown in the exemplary cross-sections of FIGS. 19, 20, 21, and 24, a corrugated structure may provide a wave structure 610 for added stiffness. As shown in FIGS. 22-24, the corrugated structure may define zig-zag ridges 612 and elongated hexagonal depressions 614. Referring to FIGS. 22 and 23, which illustrate a first side of the layer 602, in embodiments, a corrugated pattern may be defined by offset rows of the elongated hexagonal depressions 614. As shown, each row of hexagonal depressions 614 may be offset in the x-direction 606 from an adjacent row of hexagonal depressions 614 such that adjacent rows of hexagonal depressions mesh with each other. The triangular longitudinal ends 616 of the elongated hexagonal depressions 614 may define the raised zig-zag ridges 612. The elongated hexagonal depressions 614 may have a length 613 of about 39 mm, with the triangular longitudinal ends 616 having a length 611 of about 10 mm. The adjacent elongated sides 618 of the hexagonal depressions 614 may define parallel ridges 620 spaced apart at a distance 617 of approximately 10 mm. Each elongated hexagonal depression 614 may have a central valley 622, which may be parallel to the adjacent elongated sides 618, run lengthwise, and have a depth 615 of about 1.6 mm from the peak of the ridges 612, 620. The central valley 622 may extend from the vertex 623 of one triangular longitudinal end 616 to the vertex 623 of the opposite triangular longitudinal end 616 of a hexagonal depression, so as to provide two equivalent, downwardly sloping, walls extending from the ridges 612, 620 to the central valley 622. Referring to FIG. 24, which shows the opposite side of the layer 602, the corrugated pattern may be the opposite of the first side but with the same dimensions, where the ridges become valleys and vice versa. In embodiments, the opposite side may have more curved contours.

Alternative embodiments may provide differently shaped and/or sized corrugated structures, for increasing rigidity of a layer. Other corrugated structures may include ribs, protrusions, textures, and/or patterns, according to alternative embodiments.

Figure 25:
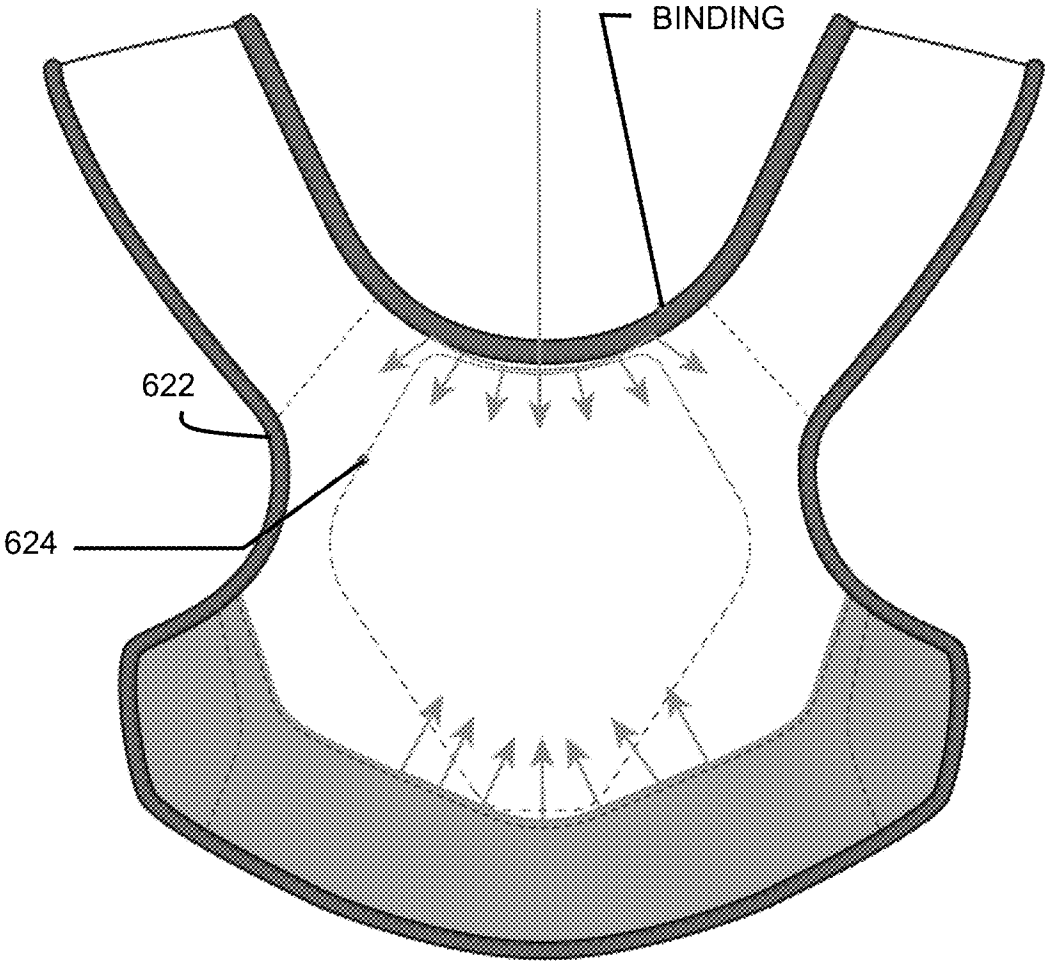
FIG. 25 is a schematic diagram that illustrates an embodiment of a base portion of a pad system, to which a chest pad may be affixed.

Chest pad 600 may be affixed to a pad system as described above in reference to chest pad 300. In embodiments, as shown in FIG. 25, chest pad 600 may be affixed to a base portion 622 at a central location 624. The attachment may be configured to minimize compression of stacked-up layers along the seams, and to keep the chest pad 600 from tilting or angling as a result of attachments (e.g., stitching) along binding and seams. As shown, chest pad 600 may have a shield shape to cover areas corresponding to the load cells of the NOCSAE chest protection standards and also to be symmetric for comfort and aesthetic factors. For both chest pads 300 and 600, the shapes and minimal footprints may provide free movement of a user's arms, may avoid restricting the user's mobility, and may minimize the weight of a pad system to avoid user fatigue during activities (e.g., running) in which the pad system is worn.

Another embodiment may provide a chest pad having more than two layers. For example, referring to FIG. 18, embodiments may provide a chest pad 630 that includes the two layers 602, 604 of chest pad 600 along with another two layers, including outer protective layer 632 and intermediate compressible substrate layer 634. While both layers 632, 624 may provide impact protection, substrate 634 may be more compressible, or softer.

Protective layer 602 and compressible substrate 604 may be constructed as described above in reference to the two-layer chest pad 600. However, because of the additional two layers 632, 624, the thickness of the protective layer 602 and/or compressible substrate 604 may be reduced to the lower end of the ranges described above, or even below those ranges.

For example, in embodiments, protective layer 602 may be a corrugated plate, which may be textured and curved (compound curvature) in both the x- and y-directions (as represented by arrows 606 and 608, respectively), may have a thickness at the lower end of the range of about 1 mm to about 5 mm, a density within a range of about 0.75 g/cm$^3$ to about 1.4 g/cm$^3$, and a Shore D hardness within a range of about 20 to about 55. In one implementation of chest pad 630, the thickness of protective layer 602 may be about 2 mm. Protective layer 602 may be molded polyethylene board, for example, 2.0 mm curved and textured polyethylene board. In another embodiment, protective layer 602 may be a 3.0 mm curved and textured, molded polyethylene board.

In addition, in embodiments of chest pad 630, compressible substrate 604 may have a thickness within a range of about 10 mm to about 60 mm (a range lower than the 30-65 mm range of the chest pad 600 alone), a density within a range of about 0.01 g/cm$^3$ to about 0.1 g/cm$^3$, and a Shore OO hardness within a range of about 0 to about 50. In one implementation, the thickness of compressible substrate 604 may be about 20 mm. Compressible substrate 604 may be a compression foam, for example, 20.0 mm polyurethane foam. In embodiments, layer 602 and substrate 604 may be molded separately and then assembled together, for example, by pressing and gluing the layer 602 onto substrate 604.

Protective layer 632 may be a corrugated plate, which may be textured and curved (compound curvature) in both the x- and y-directions as represented by arrows 606 and 608, respectively. Protective layer 632 may have a thickness within a range of about 0.5 mm to about 4 mm, a density within a range of about 0.75 g/cm$^3$ to about 1.4 g/cm$^3$, and a Shore D hardness within a range of about 20 to about 55. In embodiments, protective layer 632 may be molded polyethylene board, for example, 3.0 mm curved and textured polyethylene board. Protective layer 632 may be configured the same as protective layer 602, as described above.

Compressible substrate 634 may be a compression foam, for example, 25 Durometer ASKER C EVA foam having a thickness within a range of about 3 mm to about 35 mm. In an implementation, substrate 634 may be made of 10.0 mm 25 Durometer ASKER C EVA foam. In embodiments, substrate 604, layer 602, intermediate substrate 634, and layer 632 may be molded separately and then assembled together, for example, by pressing and gluing one or more of the components together.

FIG. 26 illustrates an embodiment of a front portion of a pad system incorporating a four-layer chest pad such as chest pad 630 of FIG. 18. As shown, chest pad 630 may be flexibly mounted on a base portion 640 in a chest pad area 642. In the chest pad area 642 underneath chest pad 630, the base portion 640 may include an outer layer of compressible foam and an inner layer of compressible foam. The outer layer may be, for example, a layer of EVA foam, such as 10 mm ASKER C 25 Durometer EVA foam. The inner layer may be, for example, a layer of polyurethane foam, such as 20 mm polyurethane foam. The outer layer and inner layer may provide a soft, cushioning layer on which to mount the chest pad 630, and thereby furnish the user with additional comfort.

As shown in FIG. 26, other portions of the base portion 640 may provide impact protection and other functionality at other locations of the user's body. In an embodiment, base portion 640 may include shoulder areas 644 and waist area 646. The shoulder areas 644 of base portion 640 may provide means for connecting base portion 640 to a back portion (worn on the back) of a pad system. In FIG. 26, the top end portions of shoulder areas 644 may connect to a back portion of a pad system. The waist area 646 of base portion 640 may be configured to connect the base portion 640 to a back portion of a pad system, for example, using adjustable straps connected to the waist area 646. The chest pad area 642, in addition to supporting a chest pad, may serve as a transition zone between the thinner areas 644, 646 and the thicker chest pad 630. In shoulder areas 644 and waist area 646, base portion 640 may have an outer layer of compressible foam and an inner layer of compressible foam. The outer layer may be, for example, a layer of EVA foam, such as 3 mm ASKER C 40 Durometer EVA foam. The inner layer may be, for example, a layer of expanded polyethylene ("EPE") foam, such as 12 mm EPE foam. The outer layer and inner layer of the areas 644, 646 may provide impact protection for a user's shoulders, collarbone, stomach, waist, and hips.

In addition to the foam stack ups of FIGS. 18 and 26, embodiments may include additional inner and outer fabric layers, which hold the foam stack ups in place and provide a finished appearance to a pad system.

Figure 27:
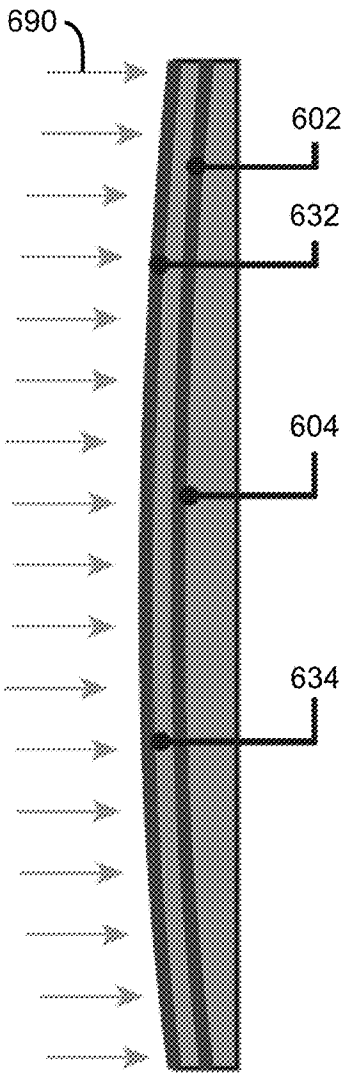
FIG. 27 is a schematic diagram that illustrates a representative impact against a multilayer chest pad, according to embodiments.

FIG. 27 illustrates a representative impact against a multilayer chest pad according to embodiments. In this representation, the chest pad may be the four-layer chest pad 630 of FIG. 18, which may include compressible substrate 604 (e.g., polyurethane foam), protective layer 602 (e.g., polyethylene board), intermediate compressible substrate layer 634 (e.g., EVA foam), and outer protective layer 632 (e.g., polyethylene board). As shown, an impact force, represented by the arrows 690, may cause the more rigid protective layers 602, 632 to compress the softer substrate layers 604, 634. In embodiments, the substantially similar geometry and size of the layers 602, 632 (e.g., in terms of the compound curvature, corrugation, thickness, and/or front-view profile) may provide an even compression of the stack up, as represented in FIG. 27.

In embodiments, the curve and/or corrugation of a protective layer may be critical to providing improved impact protection that meets industry-accepted testing standards, while also minimizing the thickness of the substrate to enhance comfort and reduce weight. A curved protective layer may provide these performance and protection improvements regardless of whether the substrate is curved. A curved and corrugated geometry—such as the geometries described in reference to FIGS. 7, 8, and 18-21—may increase the rigidity of a protective layer and may distribute forces of an impact toward the perimeter of a substrate and away from interior locations, such as the locations 102, 104, 106 of FIG. 1.

Impact testing of embodiments incorporating a curved and corrugated geometry has shown significant performance benefits in meeting the NOCSAE chest protector standards, while minimizing substrate thicknesses. The testing compared a first protective layer made of flat polypropylene thermoplastic composite board (Shore D hardness of 30) to a second protective layer made of curved and corrugated polypropylene thermoplastic composite board (Shore D hardness of 30). The first and second protective layers were tested at thicknesses of 1.34 mm, 2.7 mm, and 4 mm. The first protective layer was not curved or corrugated. The second protective layer had a curved and corrugated construction that was consistent with the embodiments of FIGS. 18-25 described above.

Figure 28:
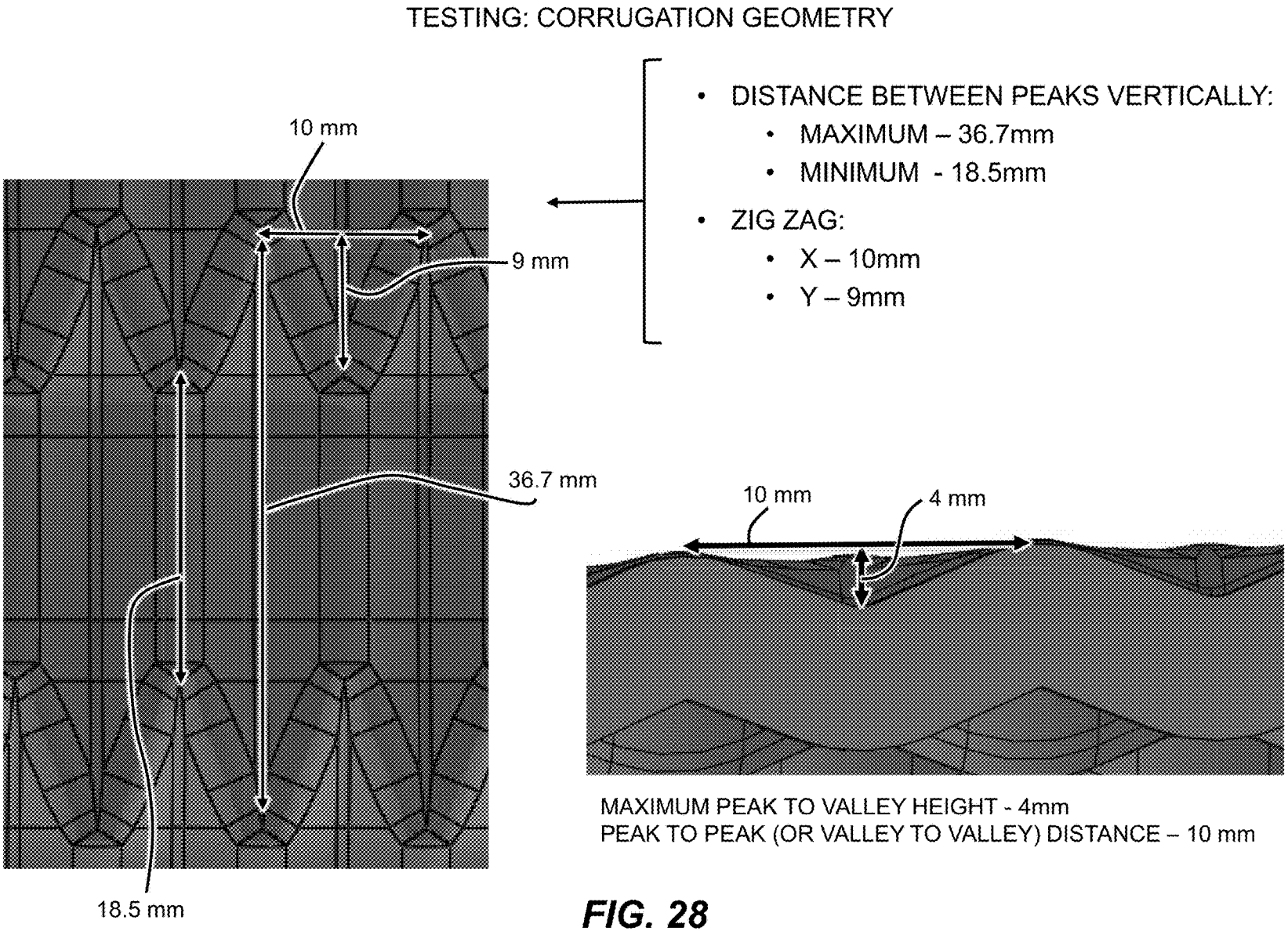
FIG. 28 is a schematic diagram that illustrates an embodiment of a corrugation geometry for a protective layer that was subjected to impact testing.
Figure 29:
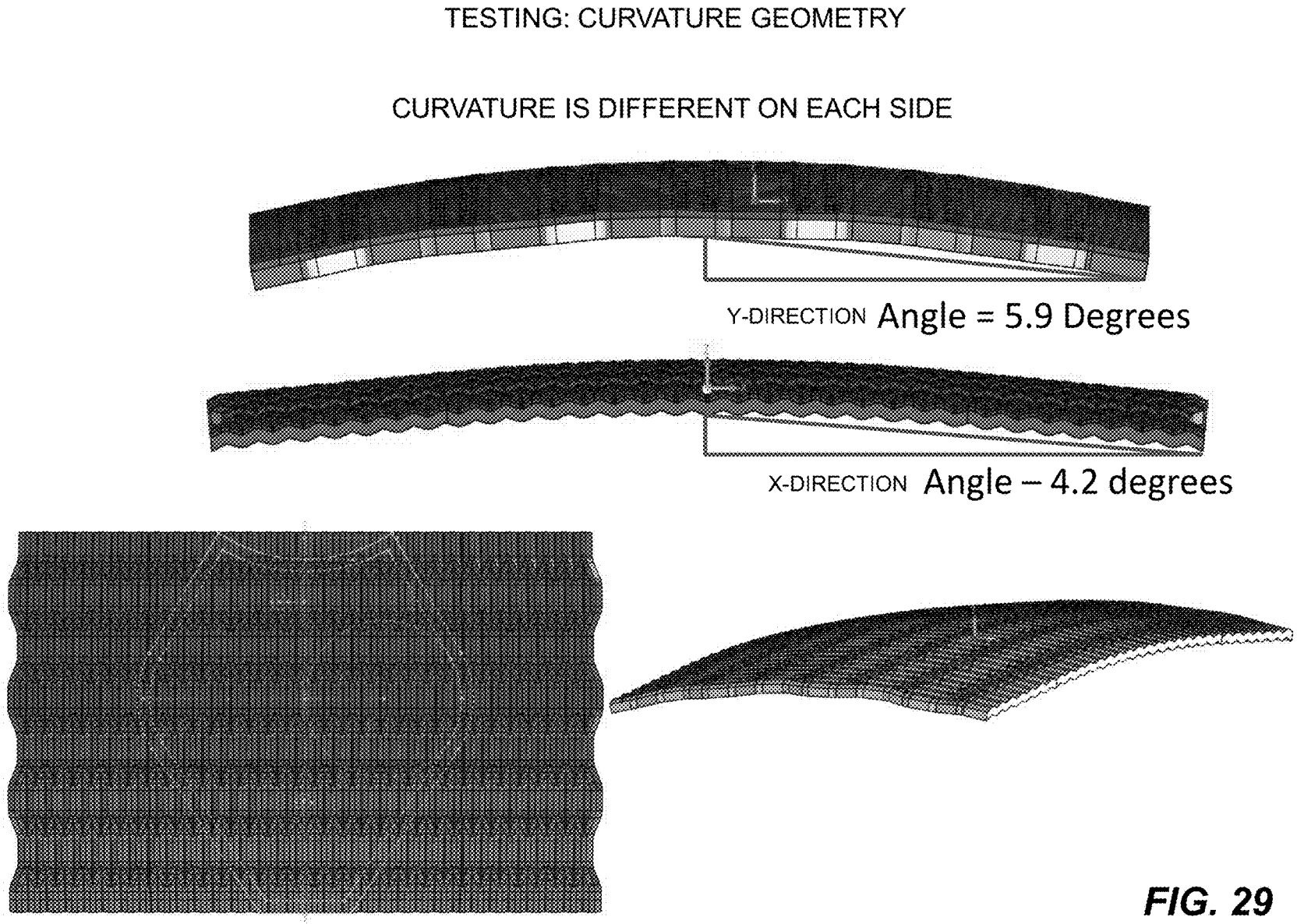
FIG. 29 is a schematic diagram that illustrates an embodiment of a curvature geometry for a protective layer that was subjected to impact testing.

FIGS. 28 and 29 illustrate the constructions of the tested second protective layer. As shown in FIG. 28, the second protective layer had zig-zag ridges and elongated hexagonal depressions, with a maximum vertical peak distance of about 36.7 mm, a minimum vertical peak distance of about 18.5 mm, a vertical zig-zag dimension of about 9 mm, a horizontal zig-zag dimension of about 10 mm, and a maximum peak-to-valley height of about 4 mm. As shown in FIG. 29, the second protective layer had a curvature geometry with a different curvature in each of the x- and y-directions, measured from an edge of the layer to the center of the layer, and relative to the horizontal plane, as shown. The angle in the y-direction was approximately 5.9 degrees. The angle in the x-direction was approximately 4.2 degrees.

The two different protective layers were tested using the cardiac load testing protocols of the NOCSAE chest protector standards, which sets a first maximum threshold of 90 lbf for a 30 mph impact and a second maximum threshold of 180 lbf for a 50 mph impact, both of which must be met to pass the standard. As represented by the schematics at the tops of FIGS. 30 and 31, each of the two protective layers was mounted on sponge foam substrates of varying thicknesses, and each stack-up was subjected to the load testing. The sponge foam substrates were made of polyurethane foam having a Shore OO 35 hardness, which is consistent with the substrate 604 described above in reference to FIG. 18. The first and second protective layers had smaller areas than the sponge foam substrates, with extra sponge foam around the entire perimeter of the foam substrates. The area ratios of the sponge foam substrates and protective layers were approximately 67% (i.e., the protective layers were about ⅔ the area of the sponge foam substrate). In embodiments, this construction may allow less area of a protective layer and may make a stack-up more convenient to manufacture.

Figure 30:
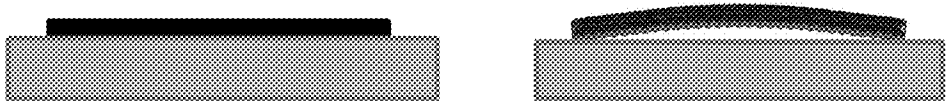
FIGS. 30 and 31 are schematic diagrams and tables illustrating results of impact testing, according to embodiments.
Figure 31:
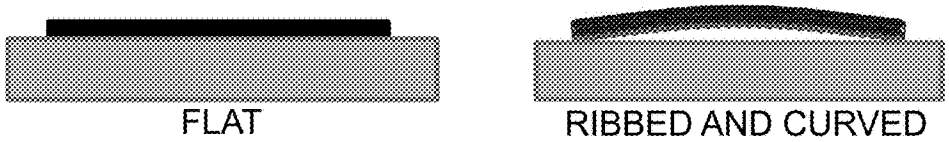
Figure 32:
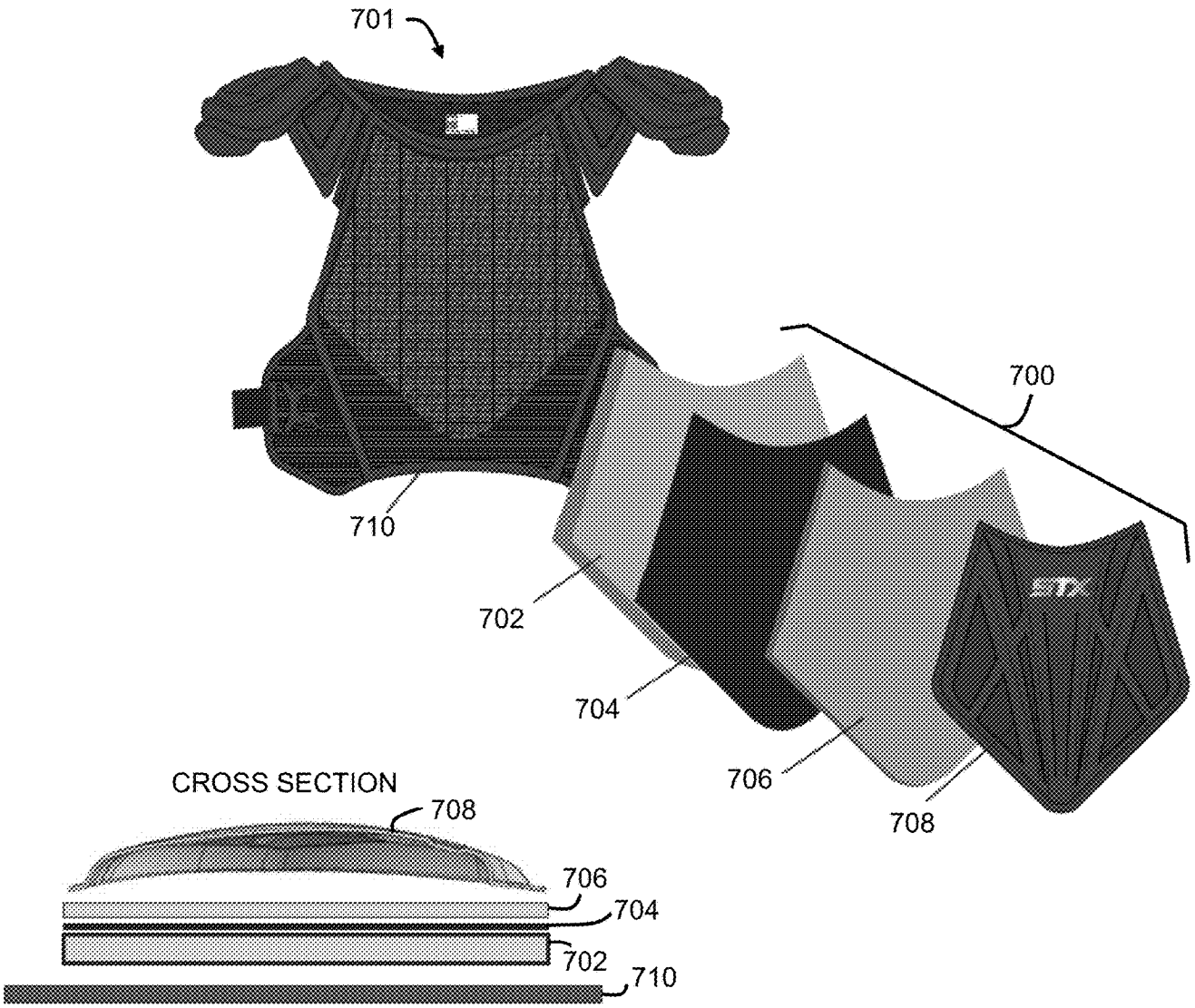
FIG. 32 is a schematic diagram that illustrates exploded and cross-sectional views of an embodiment of a pad system having a multilayer chest pad.

FIGS. 30 and 31 illustrate the results of the testing. As shown, the curved and corrugated protective layer provided impact protection improvements over the flat protective layer for every combination, except for two anomalies (1.34 mm thickness at 30 mph, and 4 mm thickness at 5 mm substrate thickness and 50 mph). And, as shown from the more extensive 4-mm thickness tests (summarized in FIG. 31), the curved and corrugated (or ribbed) protective layer passed the test with a sponge foam substrate thickness 10 mm less than the substrate thickness that the flat protective layer needed to pass the test (45 mm substrate thickness for the 4-mm flat protective layer versus 35 mm for the 4-mm curved and corrugated protective layer). Based on the testing, embodiments may provide a two-layer chest pad that complies with the NOCSAE chest protector standards, in which the substrate portion has a thickness within a range of about 30 mm to about 65 mm, a density within a range of about 0.01 g/cm$^3$ to about 0.1 g/cm$^3$, and a Shore OO hardness within a range of about 0 to about 50, and the curved and corrugated protective layer portion has a thickness within a range of about 1.5 mm to about 5 mm, a density within a range of about 0.75 g/cm$^3$ to about 1.4 g/cm$^3$, and a Shore D hardness within a range of about 20 to about 55.

As demonstrated by the testing, embodiments may provide surprising, significant improvements in impact protection due to the curved and corrugated geometry of a protective layer. The corrugation of the protective layer may increase the second moment of area (I), which increases the flexural stiffness. The greater the flexural stiffness, the greater is the load required to produce a given deflection. This increase in the flexural stiffness is for one direction. In embodiments, the corrugation (e.g., protrusions or ribs) may increase the flexural stiffness in one direction (increase $I_x$), and the zig-zags may provide that same corrugation for another direction (increase $I_y$). The impact of a ball on a protective layer may cause the layer to want to bend in two directions (both x and y), and the corrugation (e.g., ribbing and zig zags) may locally increase the second moment of area in both directions and therefore the flexural stiffness in both directions.

The curvature may work in a similar way on a macroscale. The curvature may cause the neutral axis and centroidal axis to be different. The second moment of area (I) may be calculated from the centroidal axis. By changing the centroidal axis, embodiments may again influence the flexural stiffness.

In embodiments, the corrugation and the curved geometry may together increase the flexural stiffness of a protective layer, thereby increasing the load required to deflect the board and improving impact protection.

Although embodiments may also increase stiffness by increasing the thickness of a protective layer, the curved and corrugated configurations facilitate minimal thicknesses that still have a stiff structure. This may decrease the overall stack-up thickness, and advantageously decrease the overall stack-up weight. In embodiments, the material of a protective layer may be the heaviest piece of the stack-up (around 20× more dense than the sponge foam), so reducing the thickness of the protective layer by 25%, for example, may result in a significant weight decrease. In addition, in embodiments, a protective layer may not be a significant fraction of the overall thickness (e.g., ~10%), so thickness changes in the protective layer may have minimal impact on the overall thickness.

FIGS. 32-36 illustrate additional embodiments of multilayer chest pads and the impact protection they may provide. As shown in the exploded and cross-sectional views of FIG. 32, an embodiment may include a chest pad 700 having a stack up of a base layer 702, a plate layer 704, an intermediate layer 706, and a shell 708. The stack up of layers may be mounted on a base liner 710, which may be part of a pad system 701. Base layer 702 and intermediate layer 706 may be softer than both of the plate layer 704 and the shell 708. In embodiments, base layer 702 and intermediate layer 706 may be made of foam, and base layer 702 may be thicker and/or softer than intermediate layer 706.

Base layer 702 may be made of a polyurethane sponge foam, or a thick soft spacer mesh material. Intermediate layer 706 may be made of a semi-soft foam such as traditional EVA, or an impact foam (e.g., Nitrex™). Plate layer 704 and shell 708 may be configured to provide more rigidity than base layer 702 and intermediate layer 706, for example, by the material and/or structural features such as curves, ribs, or corrugation. In embodiments, layers 702, 708 may be made of a polyethylene board, a polyethylene weave (e.g., Max Poly™), and/or a thermoplastic composite (e.g., a polypropylene thermoplastic composite material in which oriented polypropylene tapes are bonded in a polypropylene matrix, such as Curv®). In embodiments, base layer 702 may be a flat plate made of these materials, while shell layer 708 may be molded from these materials into shapes that increase rigidity, such as the convex shape shown in the cross-sectional view of in FIG. 32 and the ribbed pattern formed on the front of the shell layer 708 shown in the front view of FIG. 32.

Chest pad 700 may be mounted on a base liner 710. The base liner 710 may provide additional padding, and may have a multilayer construction, including, for example, an inner fabric layer, an outer fabric layer, and a foam layer in between the inner and outer layers, such as the constructions described above in reference to FIGS. 3-17.

Figure 33:
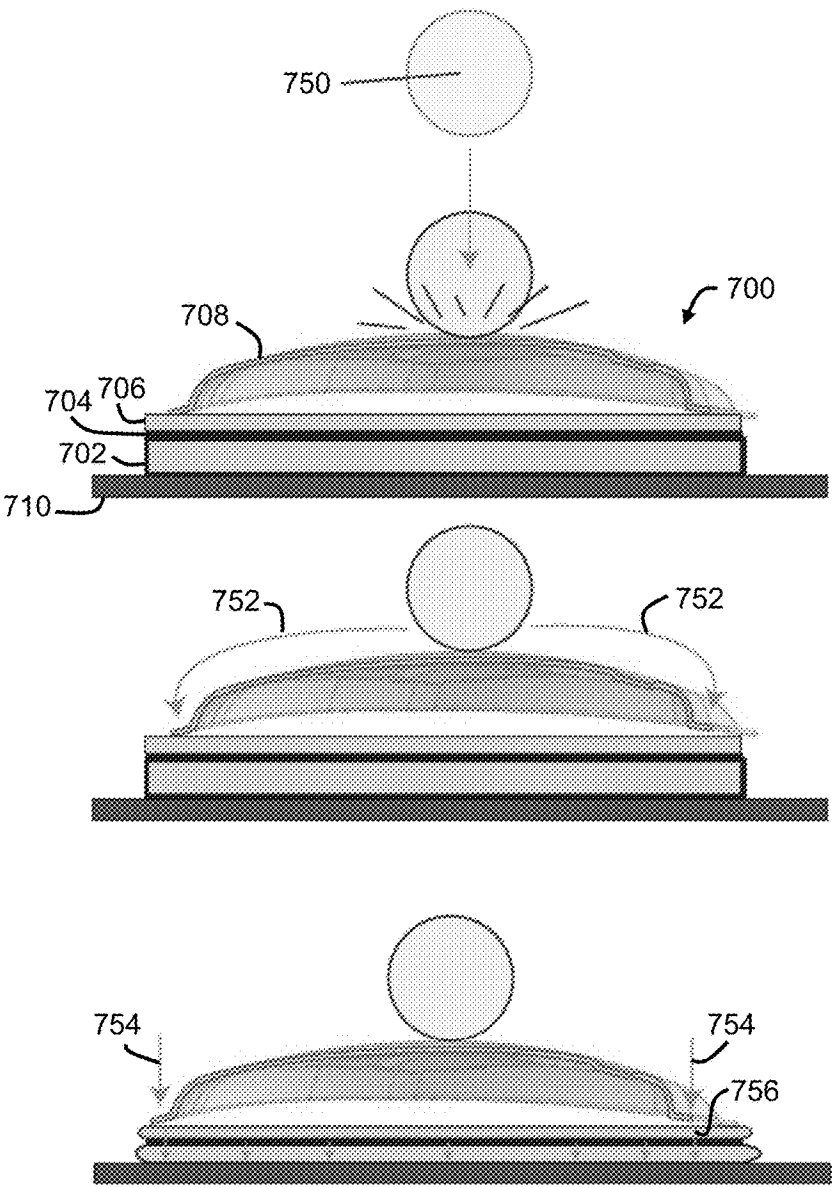
FIGS. 33-35 are schematic diagrams that illustrate impact protection provided by a chest pad, according to embodiments.
Figure 34:
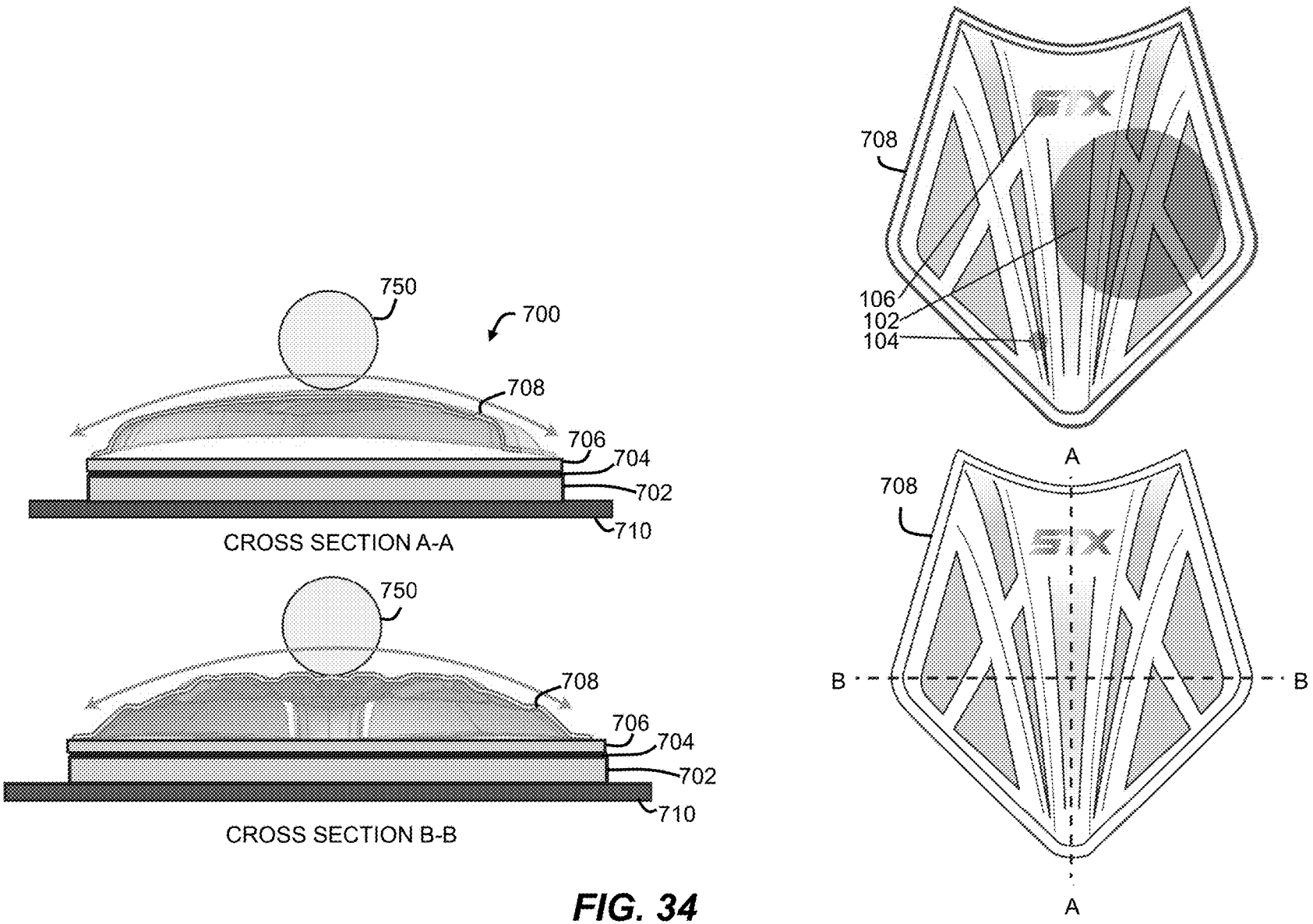
Figure 35:
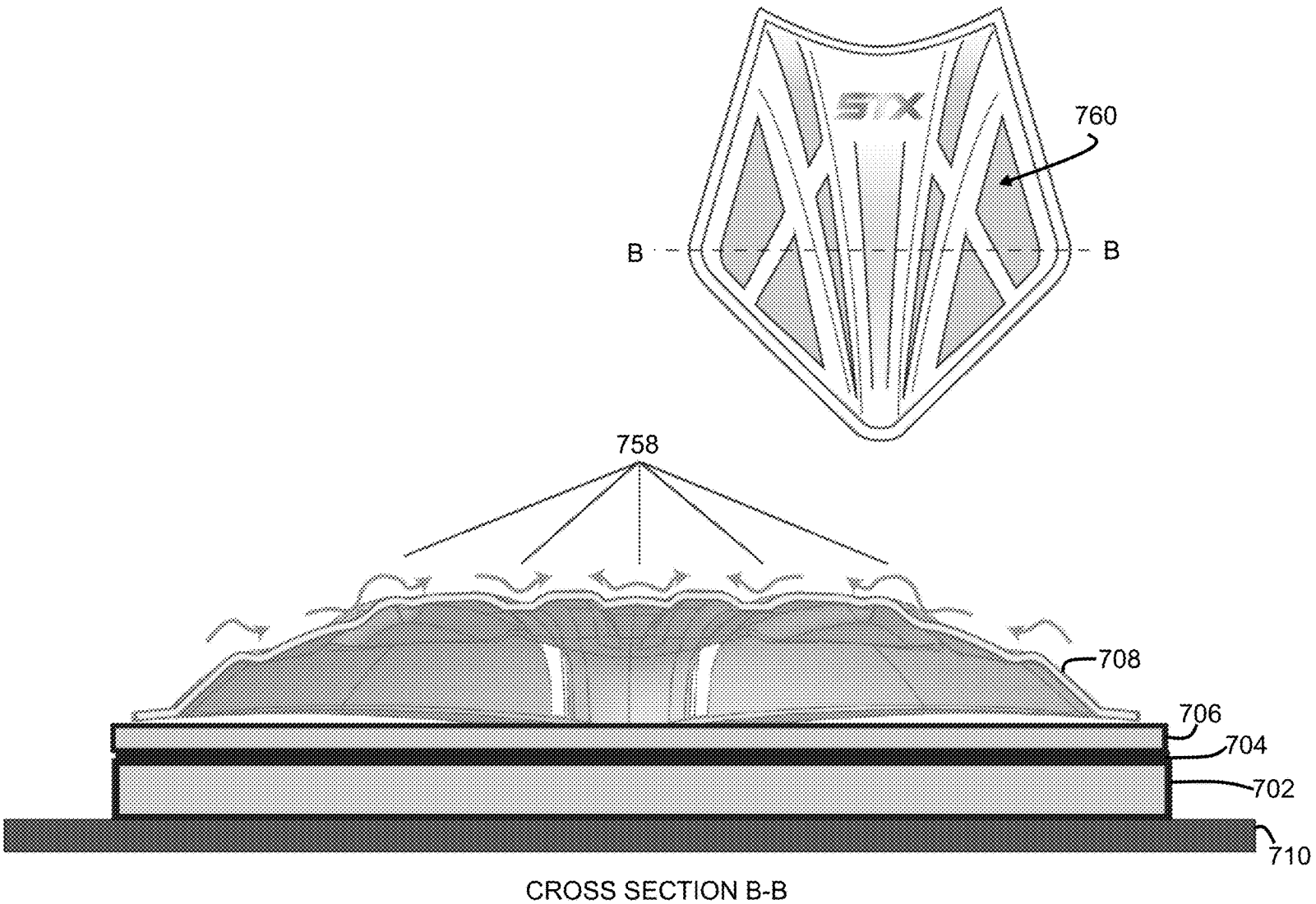

FIGS. 33-35 illustrate how the chest pad 700 may provide impact protection, according to an embodiment. As shown in FIG. 33, a ball 750 may impact the chest pad 700. The four layers 702, 704, 706, 708 of the chest pad 700 may allow the force of the impact to be evenly displaced and may decelerate the ball in a way that reduces the force transmitted to the wearer. As represented by the arrows 752, shell 708 may absorb and displace the initial impact of ball 750. The rigid design of shell 708 may resist deformation and the cavity of the shell 708 may limit direct contact between the shell 708 and intermediate layer 706 so that the impact forces are distributed around the protected area. In embodiments, chest pad 700 may be positioned on a pad system so that shell 708 spans certain areas of the chest (e.g., locations 102, 104, 106 and impact area 202 of FIG. 2), and distributes impact force around and outside those areas.

As shown in FIG. 33, as the impact continues, intermediate layer 706 may help absorb force and vibration from the shell 708. Intermediate layer 706 may then start to disperse the force of the perimeter edges of the shell 708 (as represented by arrows 754) evenly over an area larger than the edges. As the intermediate layer 706 compresses, the plate layer 704 may also compress evenly over the base layer 702, which may allow the impact energy to spread out and reduce, as represented by the arrows 756. Base layer 702 may resist transmission of the impact forces and vibration to the wearer's body, to provide the wearer with comfort and protection.

As shown in FIG. 34, when positioned over the chest of a wearer, the chest pad 700 may protect the wearer from impacts to desired areas of the chest (e.g., locations 102, 104, 106). In embodiments, as shown in FIG. 34, shell 708 may have a curved configuration, which may absorb and disperse impact and resist deformation. This configuration may keep the ball from deforming the shell 708 into contact with the intermediate layer 706, so as to minimize compression of the layers 706, 704, 702 over the desired areas of the chest and thereby disperse the impact forces around the desired areas to other areas of the chest.

To provide desired rigidity, in embodiments, shell 708 may be formed (e.g., molded) with strategically located ribbing in its surface, which may increase the stiffness of the component. This structure may prevent the shell 708 from collapsing on itself. As shown in the cross-sectional view of FIG. 35, shell 708 may have walls that define bends and ripples 758. Those wall structures may form a ribbed pattern 760, as shown in the front view of FIG. 35.

Figure 36:
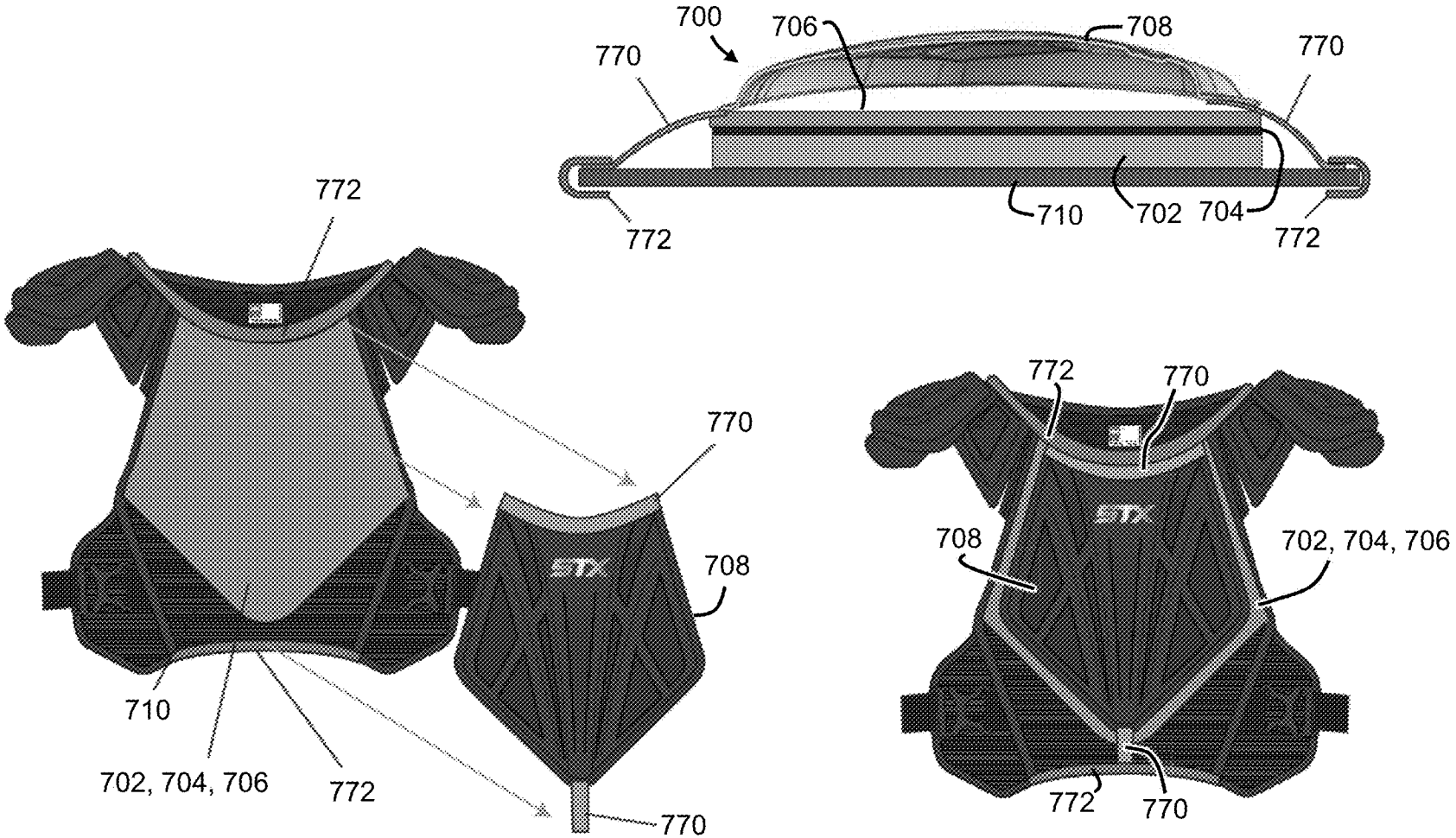
FIG. 36 is a schematic diagram that illustrates provisions for attaching a chest pad to a pad system, according to an embodiment.

Embodiments may also include provisions for attaching a chest pad to a pad system, which may allow for independent movement of the chest pad and may improve player comfort and ease of motion. For example, as shown in FIG. 36, an embodiment of a chest pad 700 may include a stack up of a base layer 702, a plate layer 704, and an intermediate layer 706 attached (e.g., stitched in place) to a base liner 710, and a shell 708 that floats freely on top of the three lower layers 702, 704, 706 and base liner 710. The shell 708 may be attached to the base liner 710 by flexible gussets 770. The gussets 770 may be made of, for example, Lycra™. The gussets 770 may be attached (e.g., sewn, glued, or welded) to the inside of binding 772 of the base liner 710. In embodiments, as shown in FIG. 36, the gussets 770 may attach an upper edge of the shell 708 adjacent to the collar of the pad system and a lower edge of the shell 708 adjacent to the waistline of the pad system. The gusset 770 at the upper edge may be continuously attached to the upper edge. The gusset 770 at the lower edge may be attached at a lower corner of the shell 708. The flexible attachments of the gussets 770 may allow shell 708 to react to a wearer's movement, allowing the wearer a free range of movement, while still constantly remaining in place over desired areas of the wearer's chest.

Figure 37:
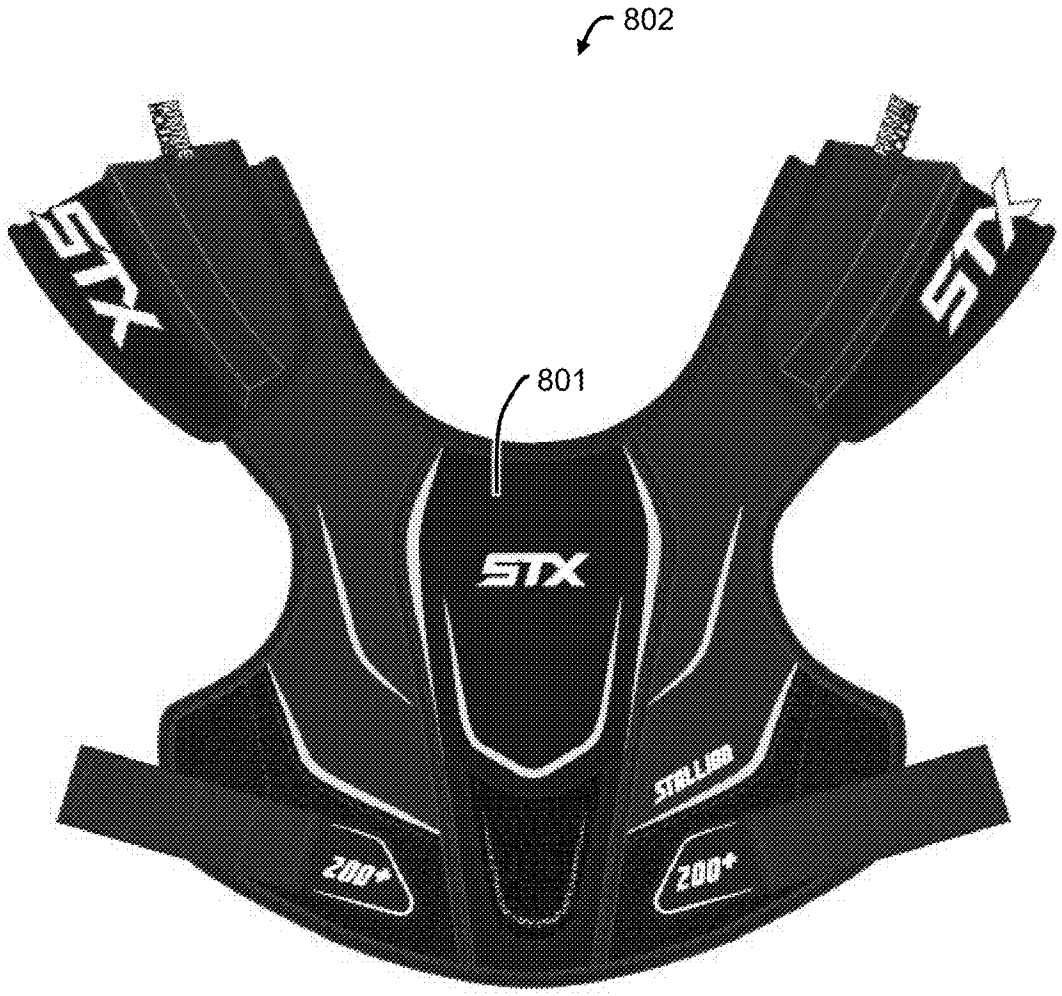

FIGS. 37-38 illustrate another embodiment of pad system, incorporating a multilayer chest pad and an additional outer elongated chest pad mounted over the chest pad. As shown, a pad system 802 may include a chest pad 800 and an elongated chest pad 801. The chest pad 800 may be substantially the same as the chest pad 630 described above in reference to FIGS. 18-27, and may include four layers, such as layers 604, 602, 634, 632 of chest pad 630. As shown in FIG. 38, the elongated chest pad 801 may be vertically oriented over the chest pad 800, and may extend from the collar to the waistline of the pad system 802. The elongated chest pad 801 may include at least one rigid protective layer, which may be mounted on an inner fabric layer or may be enclosed between an inner fabric layer and an outer fabric layer. The rigid protective layer may be made of, for example, 1 mm polyethylene board.

Embodiments may also include provisions for attaching the elongated chest pad 801 to the pad system 800, which may allow for independent movement of the elongated chest pad 801 and may improve player comfort and ease of motion. As shown in FIG. 38, for example, elongated chest pad 801 may float freely on top of chest pad 800 and may be attached to the base portion 804 by flexible gussets 870. The gussets 870 may be made of, for example, Lycra™. The gussets 870 may be attached (e.g., sewn, glued, or welded) to the inside of edge binding of the base portion 804. In embodiments, as shown in FIG. 38, the gussets 870 may attach an upper edge of the elongated chest pad 801 adjacent to the collar of the pad system 802 and a lower edge of the elongated chest pad 801 adjacent to the waistline of the pad system 802. The gusset 870 at the upper edge may be continuously attached to the upper edge, or may be one or more separate gussets, such as the two gussets attached at the upper two corners of the elongated chest pad 801, as shown in FIG. 38. The gusset 870 at the lower edge may be attached at a lower corner of the elongated chest pad 801. The flexible attachments of the gussets 870 may allow the elongated chest pad 801 to react to a wearer's movement, allowing the wearer a free range of movement, while still constantly remaining in place over desired areas of the wearer's chest.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or hand covering.

It should also be noted that relative terms such as "over," "underneath," "side," "top," and "bottom," are used herein to describe the embodiments as depicted in the accompanying figures and are not intended to be limiting.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A body pad comprising: a substrate portion; and a protective layer portion disposed on the substrate portion, wherein, when viewed from a front view, the substrate portion and the protective layer portion extend generally in an x-direction and a y-direction defining an x-y plane, wherein along the y-direction the protective layer portion is curved outwardly in a z-direction perpendicular to the x-y plane, wherein the substrate portion has a thickness within a range of 30 mm to 65 mm, a density within a range of 0.01 g/cm3 to 0.1 g/cm3, and a Shore 00 hardness within a range of 0 to 50, and wherein the protective layer portion has a thickness within a range of 1.5 mm to 5 mm, a density within a range of 0.75 g/cm3 to 1.4 g/cm3, and a Shore D hardness within a range of 20 to 55.

2. The body pad of claim 1, wherein the protective layer portion comprises at least one of a polyethylene board, a polyethylene weave, or a polypropylene thermoplastic composite.

3. The body pad of claim 1, wherein the substrate portion comprises a polyurethane foam.

4. The body pad of claim 1, wherein along the y-direction the substrate portion is curved outwardly in the z-direction at a radius of curvature substantially equal to a radius of curvature of the protective layer portion along the y-direction.

5. The body pad of claim 1, wherein along the y-direction the protective layer portion has a radius of curvature within a range of 265 mm to 665 mm.

6. The body pad of claim 1, wherein along the x-direction the protective layer portion has a radius of curvature within a range of 578 mm to 1178 mm.

7. The body pad of claim 1, wherein along the x-direction the substrate portion is curved outwardly in the z-direction.

8. The body pad of claim 1, wherein the protective layer portion is corrugated with zig-zag ridges to increase rigidity of the protective layer portion.

9. The body pad of claim 8, wherein the protective layer portion has rows of hexagonal depressions extending in a first direction, wherein each hexagonal depression of the rows of hexagonal depressions is elongated in a second direction perpendicular to the first direction, such that the each hexagonal depression is longer in the second direction than in the first direction, and wherein each row of hexagonal depressions is offset in the first direction from an adjacent row of hexagonal depressions such that adjacent rows of hexagonal depressions mesh with each other.

10. The body pad of claim 9, wherein the each hexagonal depression defines:

a first elongated side extending linearly in the second direction;

a second elongated side opposite to the first elongated side and extending linearly in the second direction;

a first triangular longitudinal end extending from the first and second elongated sides and defining a first vertex;

a second triangular longitudinal end opposite to the first triangular longitudinal end, extending from the first and second elongated sides, and defining a second vertex, wherein the first vertex and the second vertex are aligned in a line extending parallel to the second direction; and a central valley extending from the first vertex to the second vertex.

11. The body pad of claim 1, wherein the body pad is configured to be worn on a chest of a user with the substrate portion disposed closest to the user, wherein, when viewing the body pad from the z-direction, the body pad defines:

a concave upper edge configured to be disposed under a neck of the user and have a first end portion and a second end portion, a first side edge extending from the first end portion of the concave upper edge and angled outwardly with respect to the x-direction toward a first side obtuse corner portion, a second side edge opposite to the first side edge, extending from the second end portion of the concave upper edge and angled outwardly with respect the x-direction toward a second side obtuse corner portion apex, a third side edge extending linearly from a first end at the first side obtuse corner portion and angled inwardly with respect to the x-direction to a second end, a fourth side edge extending linearly from a first end at the second side obtuse corner portion and angled inwardly with respect to the x-direction to a second end, and a lower edge extending in the x-direction and connecting the second end of the third side edge and the second end of the fourth side edge, such that the body pad is configured to extend across a chest of the user from the first side obtuse corner portion to the second side obtuse corner portion.

12. The body pad of claim 1, wherein the protective layer portion comprises a first protective layer portion, and wherein the body pad further comprises:

an intermediate layer disposed over the first protective layer portion on a side of the first protective layer portion opposite to the substrate portion; and a second protective layer portion disposed on the intermediate layer on a side of the intermediate layer opposite to the first protective layer portion, wherein along the y-direction the second protective layer portion is curved outwardly in the z-direction.

13. The body pad of claim 12, wherein the intermediate layer comprises ethylene-vinyl acetate foam having a Durometer Type C hardness of 25 and having a thickness within a range of 3 mm to 35 mm, and wherein the second protective layer portion comprises polyethylene board and has a thickness within a range of 0.5 mm to 4 mm, a density within a range of 0.75 g/cm3 to 1.4 g/cm3, and a Shore D hardness within a range of 20 to 55.

14. The body pad of claim 1, wherein the body pad meets requirements of National Operating Committee on Standards for Athletic Equipment NOCSAE Doc (ND) 200-17a M18, Revised June 2017, Modified January 2018, Effective June 2018, defining a cardiac silhouette location, a lower load cell location, and an upper load cell location, when the body pad is placed over the cardiac silhouette location, the lower load cell location, and the upper load cell location.

15. A body pad comprising: a substrate portion; and a first protective layer portion disposed on the substrate portion, wherein, when viewed from a front view, the substrate portion and the protective layer portion extend generally in an x-direction and a y-direction defining an x-y plane, wherein along the y-direction the protective layer portion is curved outwardly in a z-direction perpendicular to the x-y plane, wherein the substrate portion has a thickness within a range of 10 mm to 60 mm, a density within a range of 0.01 g/cm3 to 0.1 g/cm3, and a Shore 00 hardness within a range of 0 to 50, and wherein the protective layer portion has a thickness within a range of 1 mm to 5 mm, a density within a range of 0.75 g/cm3 to 1.4 g/cm3, and a Shore D hardness within a range of 20 to 55; an intermediate layer disposed over the first protective layer portion on a side of the first protective layer portion opposite to the substrate portion, wherein the intermediate layer comprises ethylene-vinyl acetate foam having a Durometer Type C hardness of 25 and having a thickness within a range of 3 mm to 35 mm; and a second protective layer portion disposed on the intermediate layer on a side of the intermediate layer opposite to the first protective layer portion, wherein along the y-direction the second protective layer portion is curved outwardly in the z-direction, and wherein the second protective layer portion comprises polyethylene board and has a thickness within a range of 0.5 mm to 4 mm, a density within a range of 0.75 g/cm3 to 1.4 g/cm3, and a Shore D hardness within a range of 20 to 55.

* * * * *